US007148805B2

(12) United States Patent
Hogan

(10) Patent No.: US 7,148,805 B2
(45) Date of Patent: Dec. 12, 2006

(54) HARD SECURITY TAG AND DETACHING DEVICE

(75) Inventor: Dennis L. Hogan, Lighthouse Point, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 267 days.

(21) Appl. No.: 10/637,202

(22) Filed: Aug. 8, 2003

(65) Prior Publication Data

US 2005/0030182 A1 Feb. 10, 2005

(51) Int. Cl.
*G08B 13/14* (2006.01)

(52) U.S. Cl. ..... 340/572.9; 340/572.1; 340/572.8; 24/704.1

(58) Field of Classification Search ..... 340/572.8, 340/572.1, 572.9, 825.56, 551, 568.1; 70/51.1, 70/391, 416, 453, 654; 24/704.1, 707.5, 24/110, 114.4

See application file for complete search history.

(56) References Cited

U.S. PATENT DOCUMENTS

| | | | | |
|---|---|---|---|---|
| 3,995,900 | A | 12/1976 | Humble et al. | 292/316 |
| 4,156,302 | A * | 5/1979 | Van Niel | 24/707.5 |
| 4,502,717 | A * | 3/1985 | Close | 70/57.1 |
| 5,031,756 | A | 7/1991 | Buzzard et al. | 206/1.5 |
| 5,426,419 | A | 6/1995 | Nguyen et al. | 340/572 |
| 5,528,914 | A | 6/1996 | Nguyen et al. | 70/57.1 |
| 5,535,606 | A | 7/1996 | Nguyen et al. | 70/57.1 |
| 5,942,978 | A | 8/1999 | Shafer | 340/572.9 |
| 5,955,951 | A | 9/1999 | Wischerop et al. | 340/572.8 |
| 6,096,153 | A * | 8/2000 | Nowaczyk | 156/199 |
| 6,373,390 | B1 | 4/2002 | Hogan et al. | 340/572.8 |
| 6,535,130 | B1 * | 3/2003 | Nguyen et al. | 340/572.9 |

* cited by examiner

*Primary Examiner*—Anh V. La
(74) *Attorney, Agent, or Firm*—Kacvinsky LLC

(57) ABSTRACT

A method and apparatus for a hard security tag and detaching device are described. The hard security tag may include a sensor to emit a detectable signal when it is in a monitored surveillance zone. The hard security tag may be attached to an item, such as an article of clothing. The detaching device may detach the hard security tag from the item.

49 Claims, 36 Drawing Sheets

2514
0°
2510
2520
2528
2518
2534
2514
2542
2586
2548
2512
2524
2582
2544
2604
~45°
2508
2608
2610
2532
2544
2616
~45°
2612
2606
2618
2522
2620
2606
138
2602
0°
2530
2550
2538
2584
2560
2558
2556
130
100
132

HARD SECURITY TAG AND DETACHING DEVICE

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as an article of clothing. If the monitored item enters the surveillance zone, an alarm may be triggered indicating unauthorized removal of the monitored item from the controlled area. Security tags are typically attached to the article of clothing using a metal tack with a large head.

The security tag may be designed for reuse. For example, a security tag may be removed from the monitored item at the point of sale in a manner that does not substantially harm the integrity of the security tag, either externally or internally. Conventional reusable security tags, however, may be relatively expensive since they are made to be durable enough to withstand the rigors of continuous attaching and detaching from monitored items. Consequently, there may be a need for improved security tags to solve these and other problems.

BRIEF DESCRIPTION OF THE DRAWINGS

The subject matter regarded as embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Figure 1:
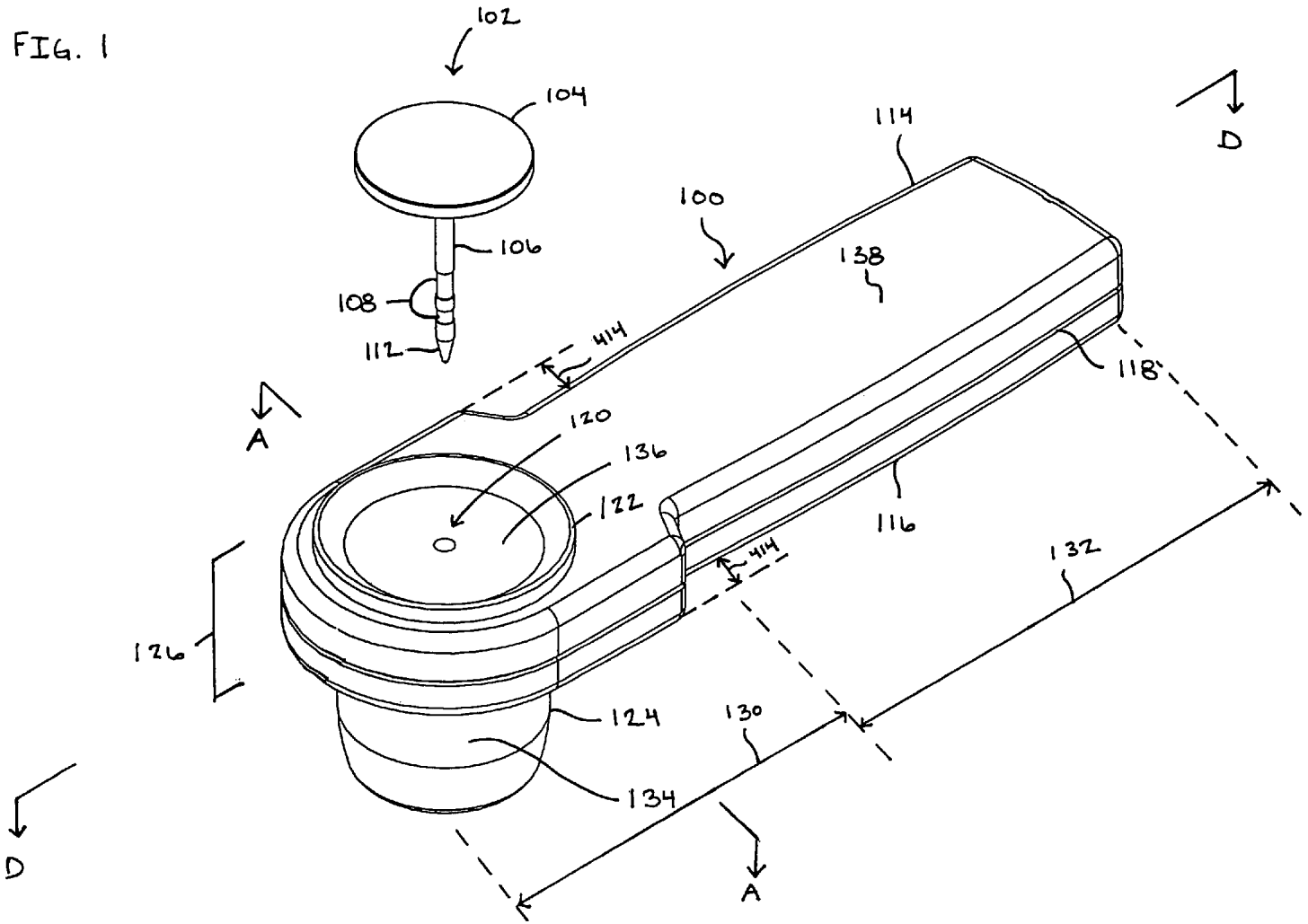
FIG. 1 illustrates a security tag and a tack assembly in accordance with one embodiment.

The embodiments may be directed to a security system. The security system may be, for example, an EAS system. The EAS system may comprise a security tag, a detaching device and monitoring system. In general operation, the security tag may include a sensor to emit a detectable signal when it is in the monitored surveillance zone. The security tag may be attached to an item, such as an article of clothing. The detaching device may detach the security tag from the item. The monitoring system may monitor a controlled area for the signal to ensure that the item with the security tag is not removed from the controlled area.

In one embodiment the security tag may be, for example, a hard security tag designed for single use. The detaching device may detach the security tag from the item in a manner that damages the tag and prevents its reuse. Since the security tag is designed for a single use, the cost of the security tag may be substantially reduced relative to conventional reusable hard security tags. Consequently, the manufacturer, retailer and consumer may benefit from the reduced costs.

For example, in one embodiment the security tag may have a security tag with a clamp disposed within the housing. The clamp may be flexible. During the attachment operation, a tack body may be inserted through the article of clothing and into a hole in the security tag, and further into the retaining aperture of the clamp. The tack body may be retained in the security tag by the clamp. During the detachment operation, the detachment device may have one or more driver rods that penetrate the outer wall of the tag body in order to access and apply pressure to the clamp thereby releasing the tack body. Once the tack body has been released from the clamp, the tack body may be removed from the security tag to detach the security tag from the item. When the driver rods are withdrawn, the outer wall may be permanently deformed. For example, the outer wall may have one or more holes or apertures. The deformed outer wall may provide a visual indication that the security tag has been used. The deformed outer wall and clamp may prevent the reuse of the security tag, although the various undamaged components may be retrieved and reused as desired.

In one embodiment, the term "penetrate" and its variations may refer to breaching a solid surface, such as a wall of the security tag. It is worthy to note that the term "penetration" may not necessarily mean that the penetrating object completely pierces through the solid surface, but may also include instances where the surface stretches or bends to accommodate the movement of the penetrating object. For example, the penetrating object may stretch the solid surface far enough to press against the clamp, with further movement causing it to bend, without the penetrating object actually touching the clamp. The embodiments are not limited in this context.

In one embodiment the security tag may be, for example, a hard security tag designed for reuse. The detaching device may detach the security tag from the item in a manner that does not permanently damage the security tag or its components. Since the security tag is designed to be reused, the retailer and consumer may benefit from the repeated use of the security tag and the reduced replacement costs.

For example, in one embodiment the security tag may have a clamp disposed within the housing. During the attachment operation, a tack body may be inserted through the article of clothing and into a hole in the security tag, and further into the retaining aperture of the clamp. The tack body may be retained in the security tag by the clamp. During the detachment operation, the detachment device may have one or more driver rods. The driver rods may penetrate the outer wall to access the clamp, or alternatively, may correspond to a pair of apertures in the security tag. The apertures may be formed prior to first use of the security tag, or formed during a previous detachment operation as described previously. The driver rods may bend, but not necessarily deform, the clamp thereby releasing the tack body. Alternatively, the rods may apply a force onto the clamp which breaks the clamp. Once the tack body has been released from the clamp, the tack body may be removed from the security tag to detach the security tag from the item. The detached security tag may now be ready for reuse with another item.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures, components and elements have not been described in detail so as not to obscure the embodiments. It can be appreciated that the specific structural and functional details disclosed herein may be representative and do not necessarily limit the scope of the embodiments.

Referring now in detail to the drawings wherein like parts are designated by like reference numerals throughout, there is illustrated in FIG. 1 a security tag and tack assembly in accordance with one embodiment. FIG. 1 may illustrate a security tag 100 and a tack assembly 102.

In one embodiment, tack assembly 102 may comprise an enlarged tack head 104 and an elongated tack body 106. Tack body 106 may also have slots or grooves 108 and a pointed forward end 112. Tack head 104 may have a diameter of approximately 0.5 inches, and a thickness of approximately 0.05 inches. Tack head 104 is typically made of plastic or steel, for example. Tack body 106 may be similar to a small pointed nail. Tack body 106 may be 0.75 inches long, and 0.046 inches in diameter. Tack body 106 is typically made of steel, for example. The embodiments are not limited in this context.

In one embodiment, tack body 106 may be made from steel, such as an American Standard (AS) 1050 or 1075. The presence of steel in or around certain detectable sensors can reduce the detectable range of the sensor, so care should be taken when selecting tack head and tack body materials. For example, one embodiment may use a sensor such as the EAS Ultra-Max® narrow label sensor made by Sensormatic® Electronics Corporation ("UltraMax Sensor"). If tack assembly 102 used with the Ultramax Sensor has residual magnetism, the sensor detectability may be reduced. Residual magnetism can occur, for example, if tack assembly 102 is made of hardened steel and has been exposed to strong magnets. This may occur during automatic attachment of tack assembly 102 with security tag 100. "Soft" steel typically does not go through a hardening process, and therefore will retain insignificant amounts of residual magnetism. Consequently, one embodiment utilizes soft steel for tack assembly 102 for use with the Ultramax Sensor. Tack assembly 102 may also be made using a plastic material for tack head 104 to reduce the overall amount of steel in tack assembly 102. The embodiments, however, are not limited to a particular sensor or material for tack assembly 102, as long as they are designed to operate compatibly with one another.

In one embodiment, tack assembly 102 may be used to attach security tag 100 to an item. The item may be for example, an article of clothing. Pointed forward end 112 may be inserted through the article of clothing and into security tag 100. The attachment operation may be discussed in more detail below.

In one embodiment, tack assembly 102 may also include additional features, such as a lanyard or security strap attached to tack head 104. The lanyard or security strap may allow security tag 100 to be used with items where penetration of the item is not desired or possible. For example, packaged items such as sports equipment, electronics and any other product may be secured with the lanyard through a stable portion of the packaging or product itself. The embodiments are not limited in this context.

In one embodiment, security tag 100 may be smaller in size than many conventional security tags. For example, security tag 100 may be 2.6 inches long, 0.8 inches wide, and 0.25 inches thick. With tack assembly 102 inserted into security tag 100, the thickness may increase to 0.67 inches. The total weight may be approximately 6 grams. The embodiments are not limited to these metrics.

In one embodiment, security tag 100 may comprise an upper housing 114 and a lower housing 116. Upper housing 114 and lower housing 116 may be joined at seam 118 to form the closed security tag 100. In one embodiment, housings 114 and 116 may be made of a semi-hard or rigid material. A usable rigid or semi-hard material might be a hard plastic, e.g., an injection molded ABS plastic, or a plastic such as polypropylene. If a plastic is used, the mating of housings 114 and 116 may be accomplished using an ultrasonic weld, snap fitting, or any suitable joining mechanism for a given implementation.

In one embodiment, security tag 100 may comprise a first end 130 and a second end 132. First end 130 and second end 132 may be partially hollow, with each having a compartment. First end 130 may have a first compartment to hold a clamp to retain tack body 106. First end 130 may also be referred to herein as an "attachment end." Second end 132 may have a second compartment to hold a sensor to emit a signal detectable by the monitoring system. Second end 132 may also be referred to herein as a "detection end."

In one embodiment, first end 130 may comprise a tag head 126. Tag head 126 may further comprise an upper housing aperture 120 and a concentric rampart 122. In one embodiment, first end 130 may be approximately 0.9 inches long and 0.825 inches wide. The shape may be similar to a half circle with a diameter of approximately 0.825 inches.

In one embodiment, first end 130 may also comprise a protrusion 124 having an outer wall 134. Protrusion 124 may comprise any desired shape, as long as the desired shape appropriately interfaces with the detaching device. In one embodiment, for example, protrusion 124 may have a cylindrical shape, as shown in FIG. 1. The embodiments are not limited in this context.

In one embodiment, second end 132 may be approximately 1.8 inches long, 0.62 inches wide and 0.22 inches thick. The shape may be similar to a rectangle. The shape and dimensions of second end 132 may allow second end 132 to act as a lever in the hand-operated version of the detaching device described herein.

As shown in FIG. 1, first end 130 and second end 132 may be positioned in line with each other, having an offset 414 at their intersection. In one embodiment, offset 414 may be an equal offset on both sides of security tag 100. In another embodiment, offset 414 may be on only one side of security tag 100. The location of offset 414, and the amount of offset 414, may vary in accordance with the particular detaching device, as discussed further below.

Although a particular external configuration is shown for security tag 100, it can be appreciated that any number of external configurations may be used for a given implementation. The external configuration for a particular implementation, however, should be made in accordance with the design and configuration of the corresponding detaching device used to detach security tag 100 from a monitored item. In one embodiment, for example, the external configuration shown for security tag 100 in general, and first end 130 in particular, have been designed to interface with the embodiments of the detaching device as described herein.

In one embodiment, upper housing aperture 120 of first end 130 may be used to receive tack body 106 during the attachment operation. The diameter of upper housing aperture 120 may be a little larger than the diameter of tack body 106 to accommodate tack body 106 during the attachment operation.

In one embodiment, concentric rampart 122 may be a rampart defining a space to receive tack head 104. The diameter of concentric rampart 122 may be a little larger than the diameter of tack head 104 to ensure tack head 104 may be properly seated during the attachment operation. In one embodiment, for example, the internal diameter of concentric rampart 122 may be approximately 0.66 inches. One purpose for concentric rampart 122 is to better secure the article between tack head 104 and security tag 100. This may better defend against attempts to pry tack assembly 102 away from security tag 100. Another purpose for concentric rampart 122 may reduce or prevent removal of security tag 100 from the detaching device during the detachment operation. Further, concentric rampart 122 may keep the article of clothing above the top surface of the detaching device, thereby reducing the possibility of snagging or tearing the article during the detachment operation.

Figure 2:
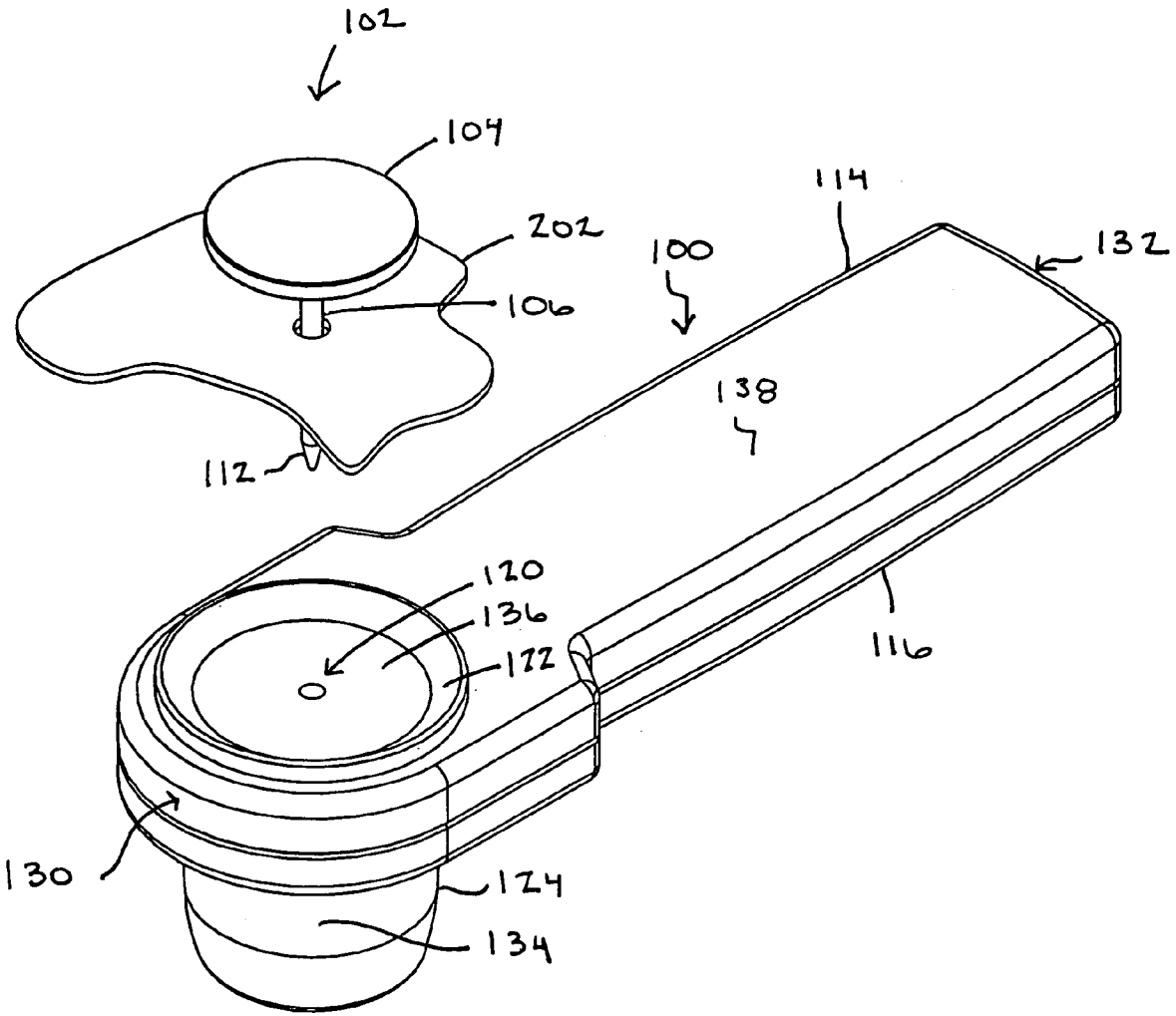
FIG. 2 illustrates a security tag, a tack assembly and an article in an unfastened position in accordance with one embodiment.

FIG. 2 illustrates a security tag, a tack assembly and an article in an unfastened position in accordance with one embodiment. FIG. 2 may illustrate the beginning of the operations to attach security tag 100 to an item, such as an article of clothing. During the attachment operation, pointed forward end 112 of tack body 106 may be inserted through an article 202. The size of tack head 104 ensures that article 202 may not be removed from tack assembly 102 without damaging article 202.

Figure 3:
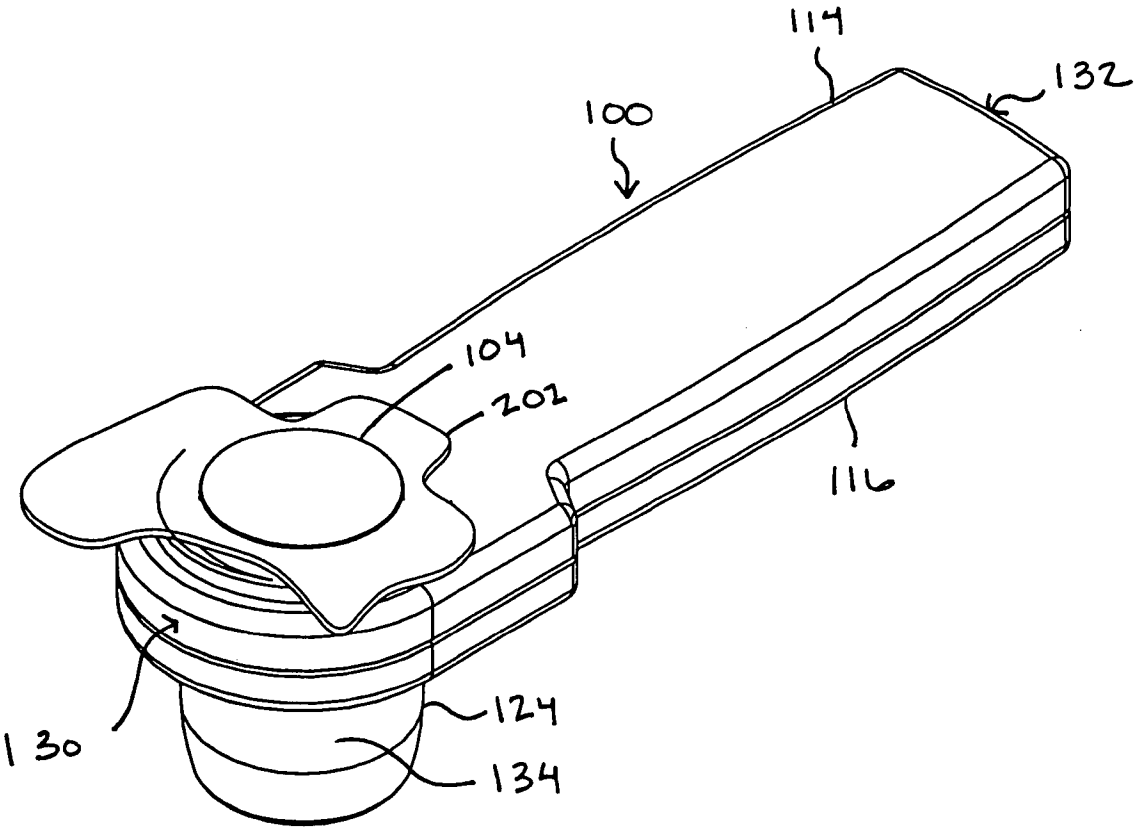
FIG. 3 illustrates a security tag, a tack assembly and an article in a fastened position in accordance with one embodiment.

FIG. 3 illustrates a security tag, a tack assembly and an article in a fastened position in accordance with one embodiment. FIG. 3 may illustrate the end of the operations to attach security tag 100 to an item, such as article 202. Once pointed forward end 112 of tack body 106 is inserted through article 202, pointed forward end 112 may be inserted into upper housing aperture 120. Force may be applied to tack head 104 until tack head 104 is seated in concentric rampart 122. Tack assembly 102 may remain attached to security tag 100 by a clamp. The clamp will be discussed in more detail below. Once seated, tack assembly 102 and security tag 100 may be securely attached to article 202. Detachment of security tag 100 from article 202 may require the use of a detaching device, as described further below.

Figure 4:
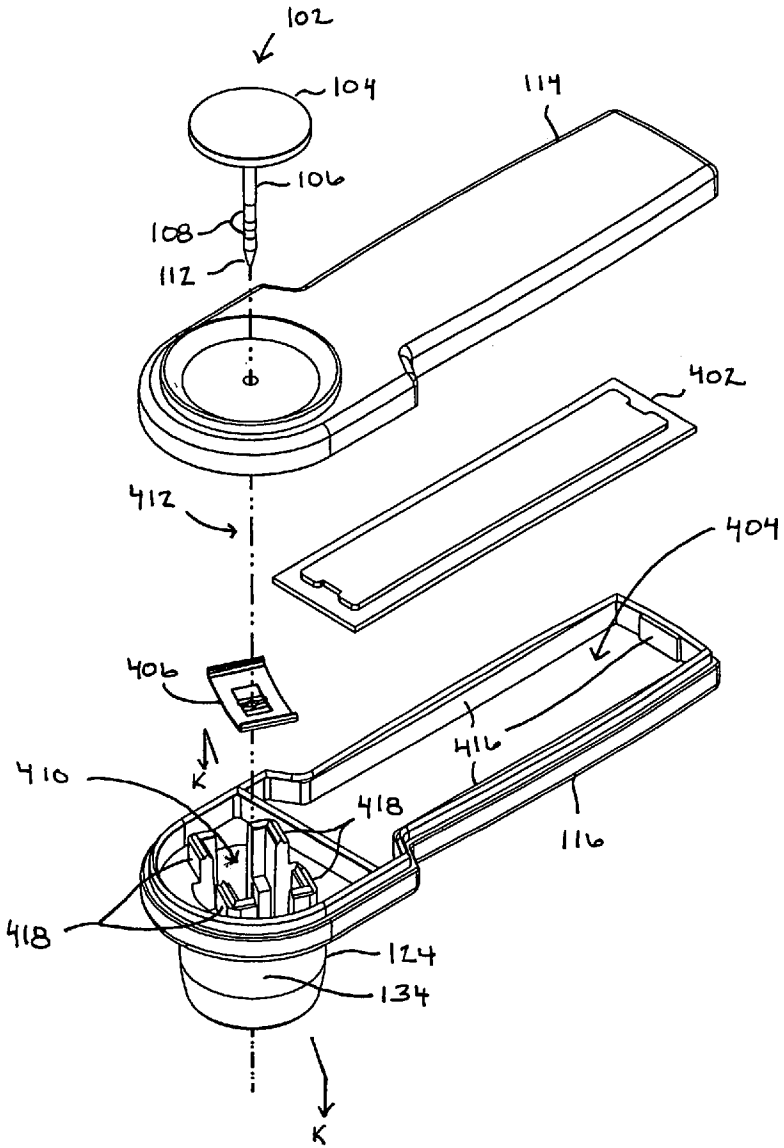
FIG. 4 illustrates a first perspective view of a disassembled security tag in accordance with one embodiment.

FIG. 4 illustrates a first perspective view of a disassembled security tag in accordance with one embodiment. FIG. 4 illustrates a first perspective view for a disassembled security tag 100. The first perspective view illustrates in particular the exterior of upper housing 114, and the interior of lower housing 116.

In one embodiment, security tag 100 may include a sensor 402. Sensor 402 may comprise any sensor capable of generating a detectable signal, such as a magnetic sensor, an acoustic magnetic sensor, a Radio-Frequency (RF) sensor, or other type of sensor. In one embodiment, for example, sensor 402 may comprise the UltraMax Sensor. The signal may be detected by an EAS monitoring system. The EAS monitoring system may include, for example, a transmitter/receiver ("transceiver") to detect the signals, and inform a monitoring system of the presence or absence of security tag 100 in the surveillance zone.

In one embodiment, lower housing 116 may have a sensor compartment 404. Sensor compartment 404 may be representative of, for example, the second compartment discussed with reference to FIG. 1. Sensor compartment 404 may comprise a plurality of walls 416 to define an area large enough for a given sensor. In one embodiment, for example, sensor 404 may be an UltraMax Sensor having the dimensions of 1.73 inches long, 0.46 inches wide and 0.085 inches thick. Other lengths and sizes can accommodate other detection technologies. Walls 416 may correspond to similar walls for upper housing 114.

In one embodiment, lower housing 116 may also have a clamp pocket 410. Clamp pocket 410 may be representative of, for example, the first compartment discussed with reference to FIG. 1. Clamp pocket 410 may comprise a plurality of walls 418 to define an area large enough for a given clamp. For example, clamp pocket 410 may be designed to receive and loosely constrain clamp 406. Pocket 410 may also be defined by a plurality of posts or other means that defines an area that receives clamp 406. When tack assembly 102 is inserted through upper housing aperture 120 along line 412, tack body 106 may be inserted through clamp 406 and into a lower cover aperture. Clamp 406 may retain tack body 106 during the attachment operation.

Once housings 114 and 116 are joined at seam 118, the first and second compartments may be closed and sealed. Sensor 402 may be securely contained, although not deformed, within sensor compartment 404. Clamp 406 may be securely contained within clamp pocket 410.

Figure 5:
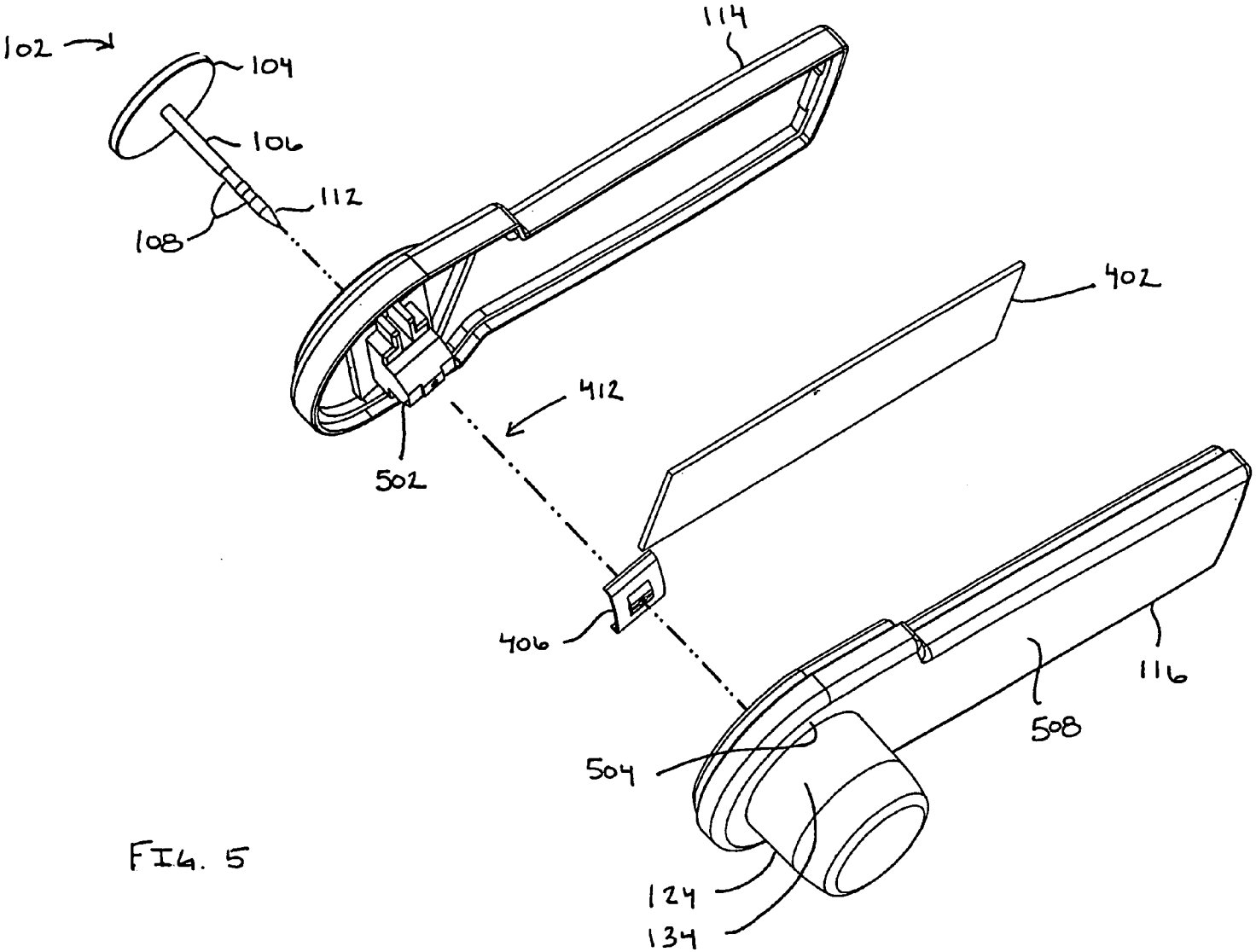
FIG. 5 illustrates a second perspective view of a disassembled security tag in accordance with one embodiment.

FIG. 5 illustrates a second perspective view of a disassembled security tag in accordance with one embodiment. FIG. 5 illustrates a second perspective view for a disassembled security tag 100. The second perspective view illustrates in particular the interior of upper housing 114, and the exterior of lower housing 116.

In one embodiment, upper housing 114 may include an abutment 502. Abutment 502 may be positioned above clamp 406 to hold clamp 406 in place when joined with lower housing 116. In other words, abutment 502 may function as a bearing surface pushing against clamp 406 and holding it in place. The position of abutment 502 may also provide resistance against clamp 406 during the detachment operation. In other words, abutment 502 may function as a bearing surface when pulling tack assembly 102 from the top. This may be discussed in further detail with reference to FIG. 11.

In one embodiment, lower housing 116 may include a surface 508. Protrusion 124 may be integrally formed with surface 508. The diameter of protrusion 124 may be smaller than the size of tag head 126. In one embodiment, the diameter of protrusion 124 is approximately 0.55 inches, and may protrude 0.45 inches. The smaller diameter may create a shoulder area 504. Shoulder area 504 may be relatively flat, and may be used to assist seating first end 130 into the detaching device during the detachment operation.

In one embodiment, the detachment operation may detach tack assembly 102 from clamp 406. Once tack assembly 102 is released from clamp 406, tack assembly 102 may be removed from security tag 100. Once tack assembly 102 has been removed from security tag 100, article 202 may be removed from tack body 106, thus completing the detachment operation. The detachment operation may be described in greater detail with reference to FIGS. 6–7 and 18–31.

Figure 6:
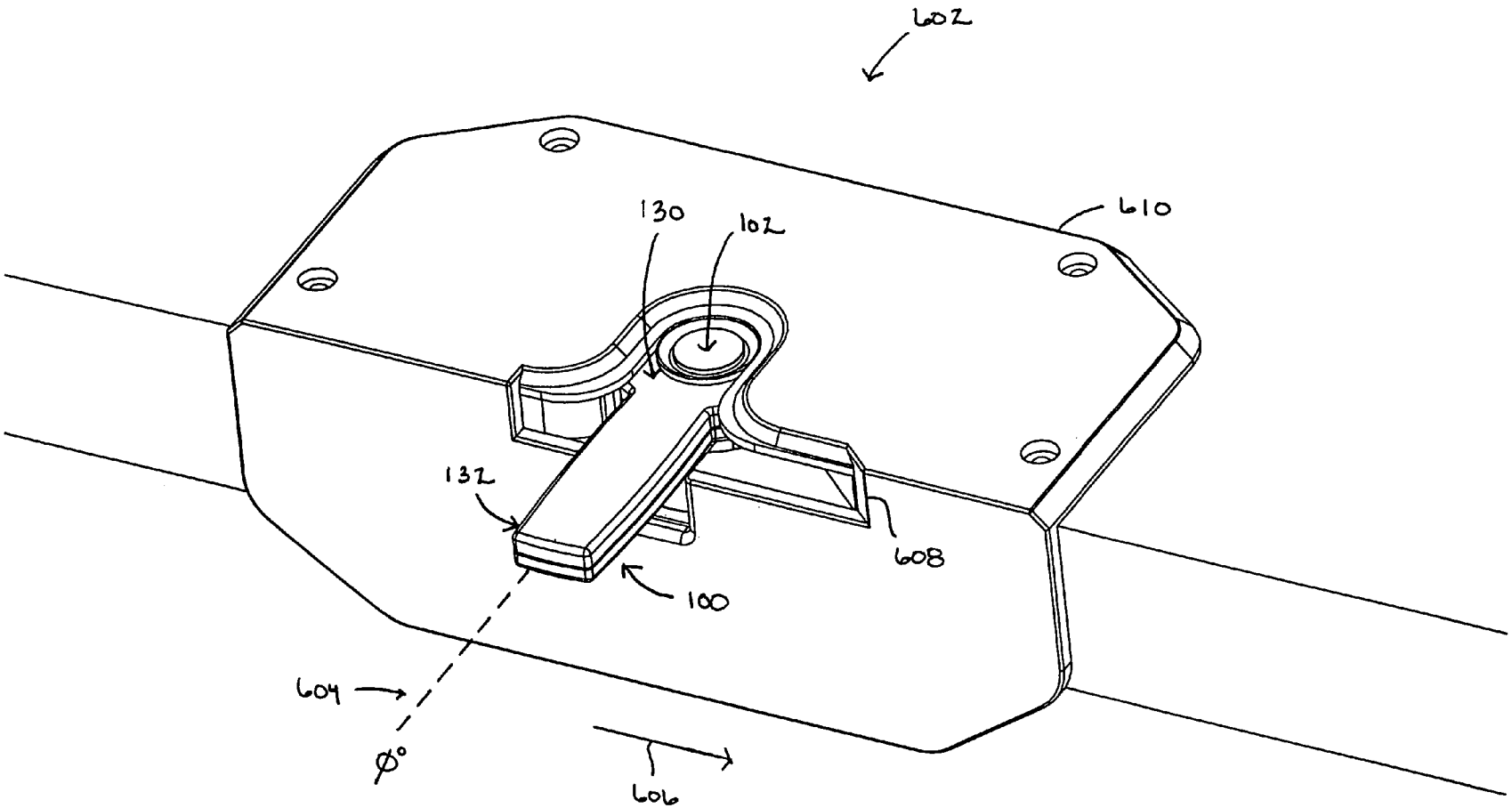
FIG. 6 illustrates a security tag inserted into a detaching device in a first position in accordance with one embodiment.

FIG. 6 illustrates a security tag inserted into a detaching device in a first position in accordance with one embodiment. FIG. 6 illustrates security tag 100 with tack assembly 102 inserted into a detaching device 602.

Detaching device 602 may be implemented in a number of ways. In one embodiment, for example, detaching device 602 may be mounted on a surface such as a desk or counter top. As shown in FIG. 6, detaching device 602 may also be mounted into the desk or counter top, such that the top surface of detaching device 602 is flush with the desk or counter top. A bezel 610 may be used to cover detaching device 602 to provide a desired finish. This configuration may be desirable, for example, to conserve space on the desk or counter top, and to provide stability for detaching device 602 during the detachment operation. In this embodiment, detaching device 602 may be approximately 6 inches long, 3 inches deep and 2 inches thick, for example. The monitored article (not shown) may lie on top of the counter during the detachment operation.

As shown in FIG. 6, first end 130 of security tag 100 may be inserted into detaching device 602 such that second end 132 is perpendicular to the edge of the detaching device along line 604. This may be referred to herein as a first position. Line 604 may be a reference line of zero (0) degrees. To detach tack assembly 102 from security tag 100, force may be applied to second end 132 in direction 606 to a second position. The force may be delivered by, for example, a person grabbing second end 132 and rotating second end 132 into the second position.

Figure 7:
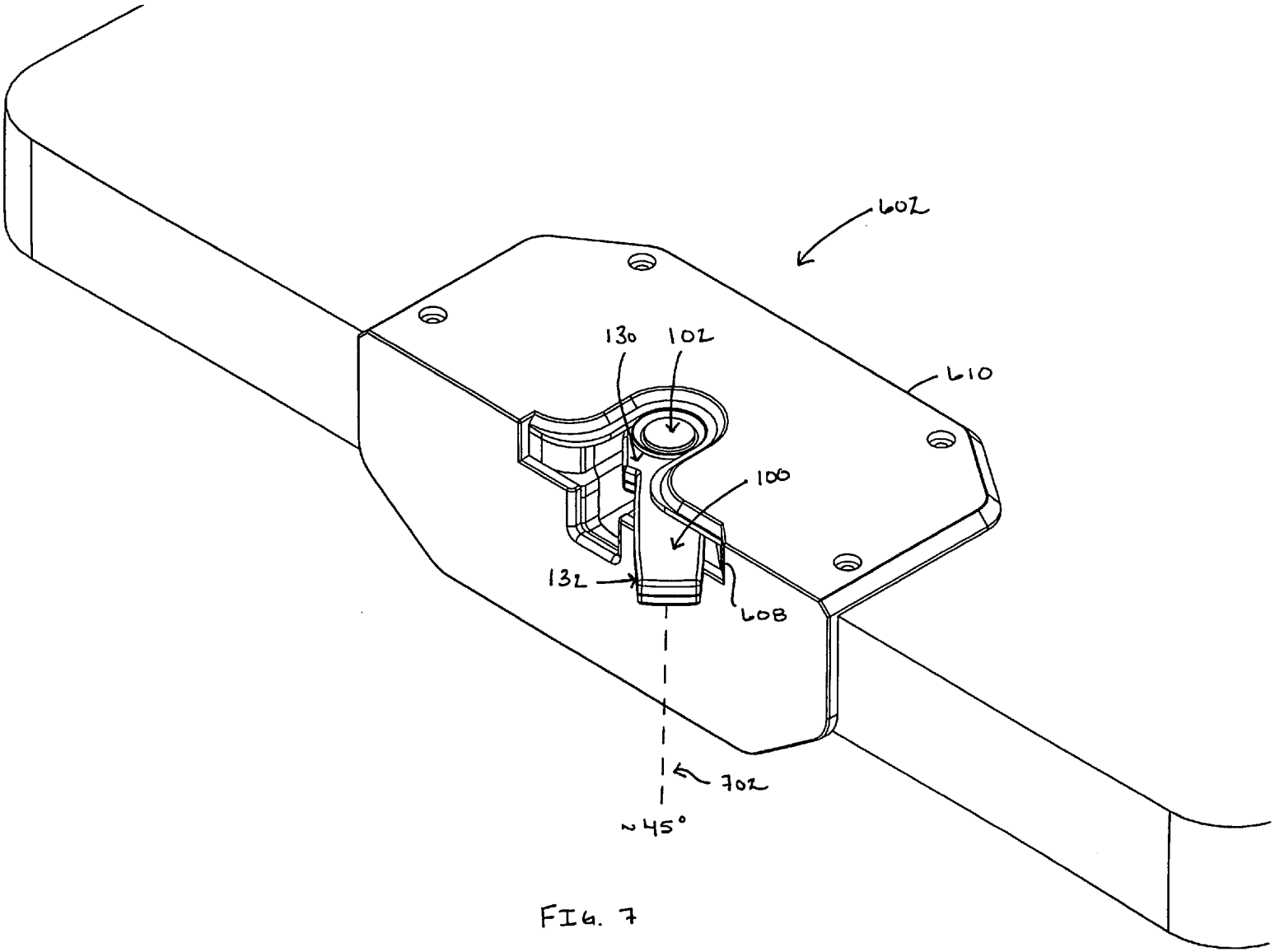
FIG. 7 illustrates a security tag inserted into a detaching device in a second position in accordance with one embodiment.

FIG. 7 illustrates a security tag inserted into a detaching device in a second position in accordance with one embodiment. FIG. 7 illustrates security tag 100 inserted into detaching device 602 and moved to a second position. The force applied to second end 132 may continue until second end 132 reaches the second position, which may or may not make contact with edge 608 of detaching device 602. Second end 132 should be along line 702 in the second position, or approximately 45 degrees from the first position.

In one embodiment, offset 414 as discussed with reference to FIG. 1 may allow a greater degree of movement between the first position and the second position for second end 132. The size of offset 414 may vary in accordance with a number of factors, such as the degree of movement required for a particular implementation, the size and shape of security tag 100, the material used for protrusion 124, the length of the driver rods and other implementation details of detaching device 602, and so forth.

In one embodiment, the movement of second end 132 from the first position to the second position releases tack body 106 of tack assembly 102 from clamp 406. The movement causes one or more driver rods to move towards outer wall 134 of protrusion 124. In one embodiment, the driver rods may penetrate outer wall 134 to access clamp 406. The driver rods proceed to contact clamp 406, and further movement bends clamp 406 against abutment 502. The bending of clamp 406 releases tack body 106 from a clamp aperture within clamp 406, as discussed in more detail with reference to FIG. 12.

Once tack body 106 is released from clamp 406, second end 132 may be moved from the second position back to the first position. This movement withdraws the driver rods from outer wall 134 of protrusion 124. Security tag 100 may then be removed from detaching device 602. After the detachment operation, protrusion 124 may have one or more holes or apertures through outer wall 134.

In one embodiment of the invention, the detachment operation may be performed using at least one driver rod and a driver rod activator. The term "driver rod activator" as used herein may refer to any structure that moves the driver rods, or assists in the movement of the driver rods, in response to a force. The force may be a manual force, automatic force, or a combination of manual and automatic force. The force moves the driver rods through outer wall 134 to bend clamp 406.

In one embodiment, the driver rod activator may be a structure that moves the driver rods in response to manual force. For example, a person may use second end 132 as a lever to move second end 132 between the first and second positions. The movement may cause another structure to move, such as a rotor, which in turn moves the driver rods. The embodiments are not limited in this context.

In one embodiment, the driver rod activator may be a structure that moves the driver rods in response to an automatic force, such as from a motor, spring, coil, and so forth. For example, a person may insert first end 130 into detaching device 602, and a motor may cause the driver rods to penetrate first end 130 and release tack body 106. In this example, second end 132 may not necessarily move from the first position to the second position during the detachment operation. Alternatively, the motor may cause another structure such as a rotor to rotate and thereby move the driver rods.

In one embodiment, the driver rod activator may be a structure that moves the driver rods in response to a combination of manual and automated techniques. For example, the movement from the first position to the second position may be performed manually, while the movement from the second position to the first position may be performed automatically through the use of a motor, spring, coil or like mechanism. The embodiments are not limited in this context.

In one embodiment, detaching device 602 may be implemented as a hand-held device. The hand-held version may comprise a pair of handles with driver rods attached at one or both ends. A user may squeeze the handles to move the driver rods a sufficient distance into security tag 100 to bend clamp 406. The hand-held version may also be automated by using a motor to drive the driver rods into security tag 100 to bend clamp 406. The embodiments are not limited in this context.

The detachment operation in general, and detachment device 602 in particular, may be discussed in more detail with reference to FIGS. 13–32.

Figure 8:
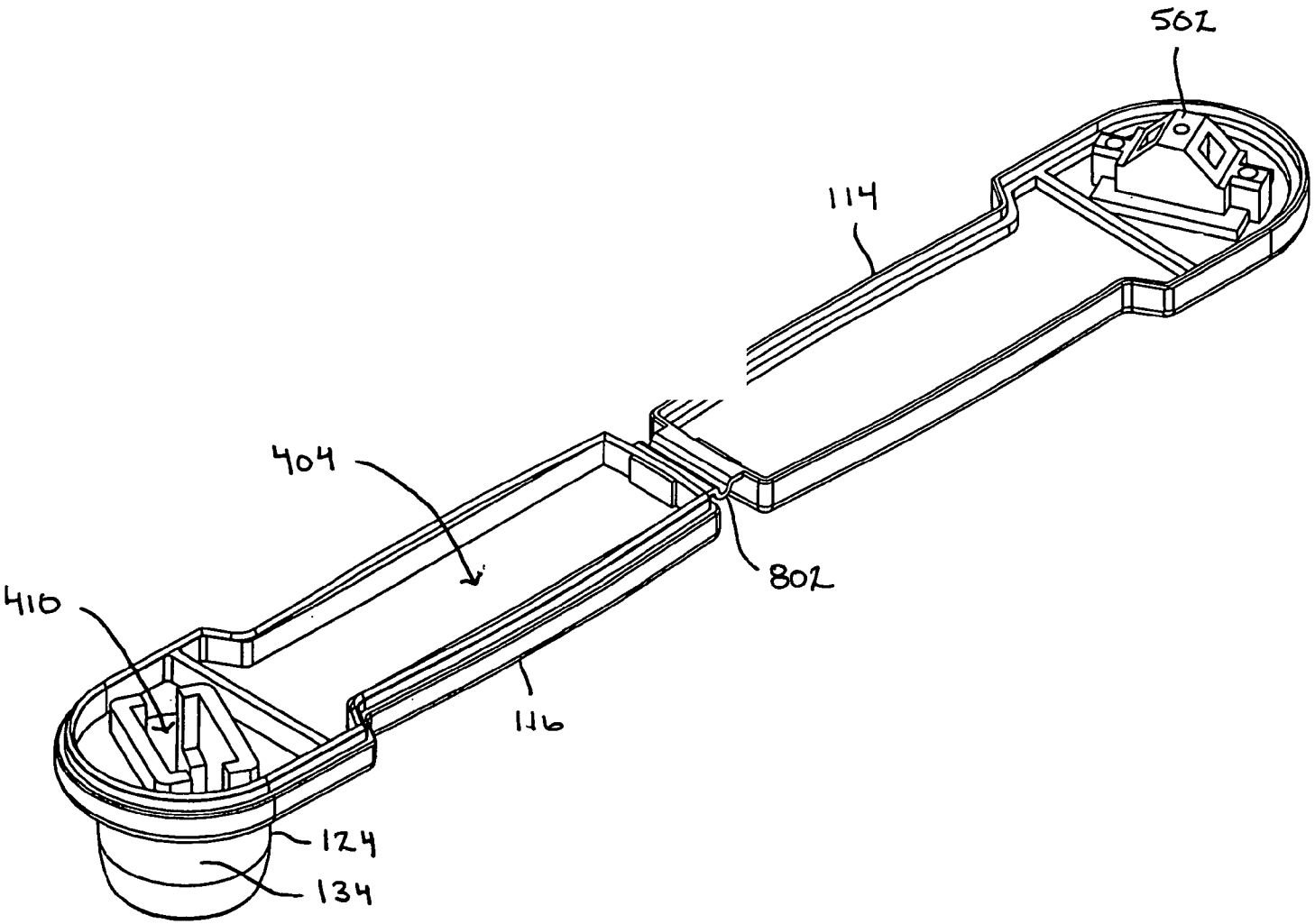
FIG. 8 illustrates a security tag with a hinge in accordance with one embodiment.

FIG. 8 illustrates a security tag with a hinge in accordance with one embodiment. As discussed previously with reference to FIGS. 4 and 5, upper housing 114 and lower housing 116 may be molded as separate elements, and welded together to form a closed security tag 100. FIG. 8 illustrates an alternative embodiment wherein upper housing 114 and lower housing 116 are molded as an integral unit joined by a hinge 802. Upper housing 114 and lower housing 116 may be folded together using hinge 802 and melded together using the previous described techniques. This embodiment may provide some assembling and cost efficiencies in producing security tag 100, for example.

Figure 9:
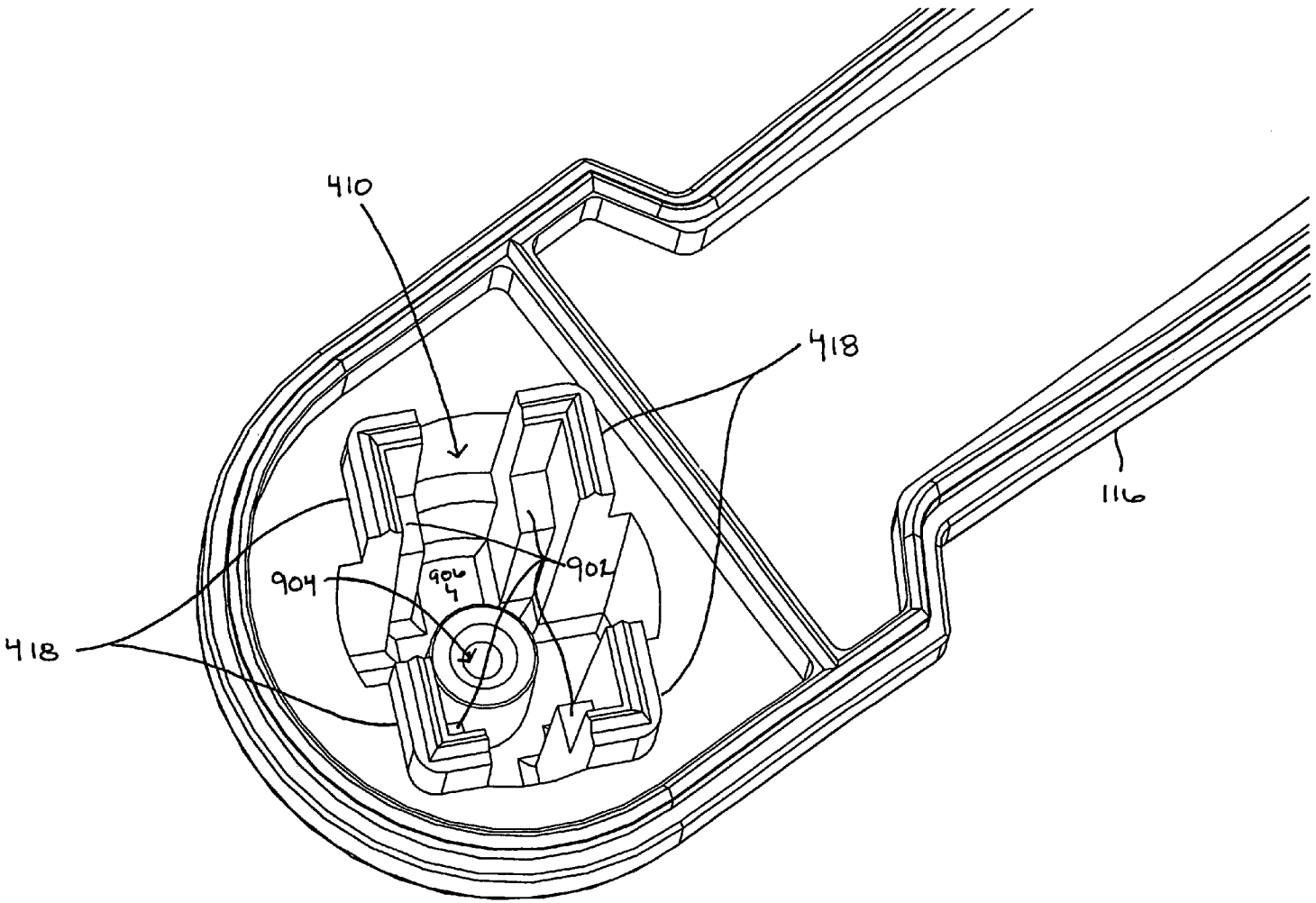
FIG. 9 illustrates an interior view of a lower housing for a security tag in accordance with one embodiment.

FIG. 9 illustrates an interior view of a lower housing for a security tag in accordance with one embodiment. FIG. 9 illustrates an interior view of lower housing 116 in greater detail. As shown in FIG. 9, lower housing 116 includes clamp pocket 410 defined by walls 418. Clamp pocket 410 may further include clamp supports 902. Clamp supports 902 may support clamp 406 when inserted into clamp pocket 410. This may be useful to provide resistance for clamp 406 when, for example, tack body 106 is inserted through clamp 406 during the attachment operation. In one embodiment, clamp supports 902 may be located at the corners of clamp pocket 410, as shown in FIG. 9. It may be appreciated, however, that clamp supports 902 may be positioned anywhere within clamp pocket 410 and still fall within the scope of the embodiments.

In one embodiment, clamp pocket 410 may also include a lower housing aperture 904. Lower housing aperture 904 may be an upstanding cavity or collar extending from an inner surface 906 of lower housing 116. When tack body 106 is fully inserted, lower housing aperture 904 may receive pointed forward end 112 of tack body 106. In one embodiment, lower housing aperture 904 may not necessarily continue through the bottom of protrusion 124. In another embodiment, however, lower housing aperture 904 may continue through the bottom of protrusion 124. This may be useful when using a modified tack assembly having a lanyard, as discussed previously, for example.

Figure 10:
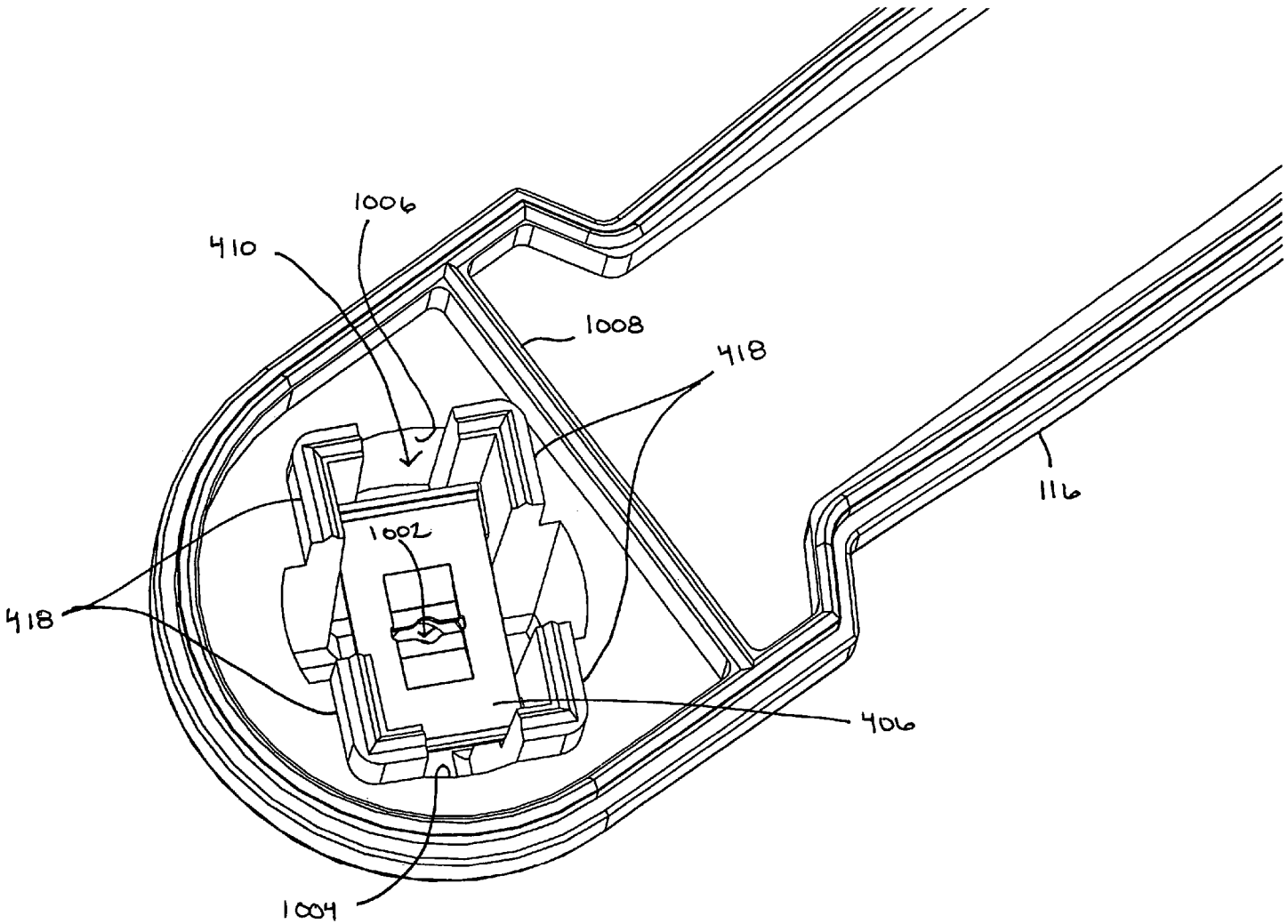
FIG. 10 illustrates an interior view of a lower housing for a security tag with an inserted clamp in accordance with one embodiment.

FIG. 10 illustrates an interior view of a lower housing for a security tag with an inserted clamp in accordance with one embodiment. FIG. 10 illustrates an interior view of lower housing 116 and inserted clamp 406 in greater detail. As shown in FIG. 10, clamp 406 may comprise a clamp aperture 1002. When clamp 406 is inserted into clamp pocket 410, clamp aperture 1002 should be aligned with lower housing aperture 904. The alignment should be approximately one-quarter the diameter of tack body 106 to ensure that pointed forward end 112 properly seats within clamp aperture 1002 and lower housing aperture 904.

In one embodiment, clamp pocket 410 may also have a pair of access walls 1004 and 1006. Access walls 1004 and 1006 may comprise part of, for example, outer wall 134 of protrusion 124. More particularly, access walls 1004 and 1006 may comprise access points for corresponding driver rods to penetrate outer wall 134 in order to access clamp 406.

In one embodiment, the thickness of access walls 1004 and 1006 may vary in accordance with a number of factors, such as the type of material used for the access walls, the shape of the driver rods penetrating the access walls, the amount of force desired to penetrate the access walls, and so forth. For example, access walls 1004 and 1006 may be made of plastic having a thickness that may be penetrated by approximately 5 to 15 pounds of force received from the driver rods, or approximately 0.010 to 0.024 inches, respectively. More particularly, the thickness may be sufficient to allow a driver rod(s) delivering approximately 7 pounds of force to penetrate access walls 1004 and 1006, or approximately 0.012 inches. The embodiments are not limited in this context.

In one embodiment, the thickness of access walls 1004 and 1006 may vary from the thickness of the rest of security tag 100. For example, the thickness of access walls 1004 and 1006 may be less than the thickness of the rest of security tag 100 to reduce the amount of force needed to penetrate access walls 1004 and 1006. The embodiments are not limited in this context.

Figure 11:
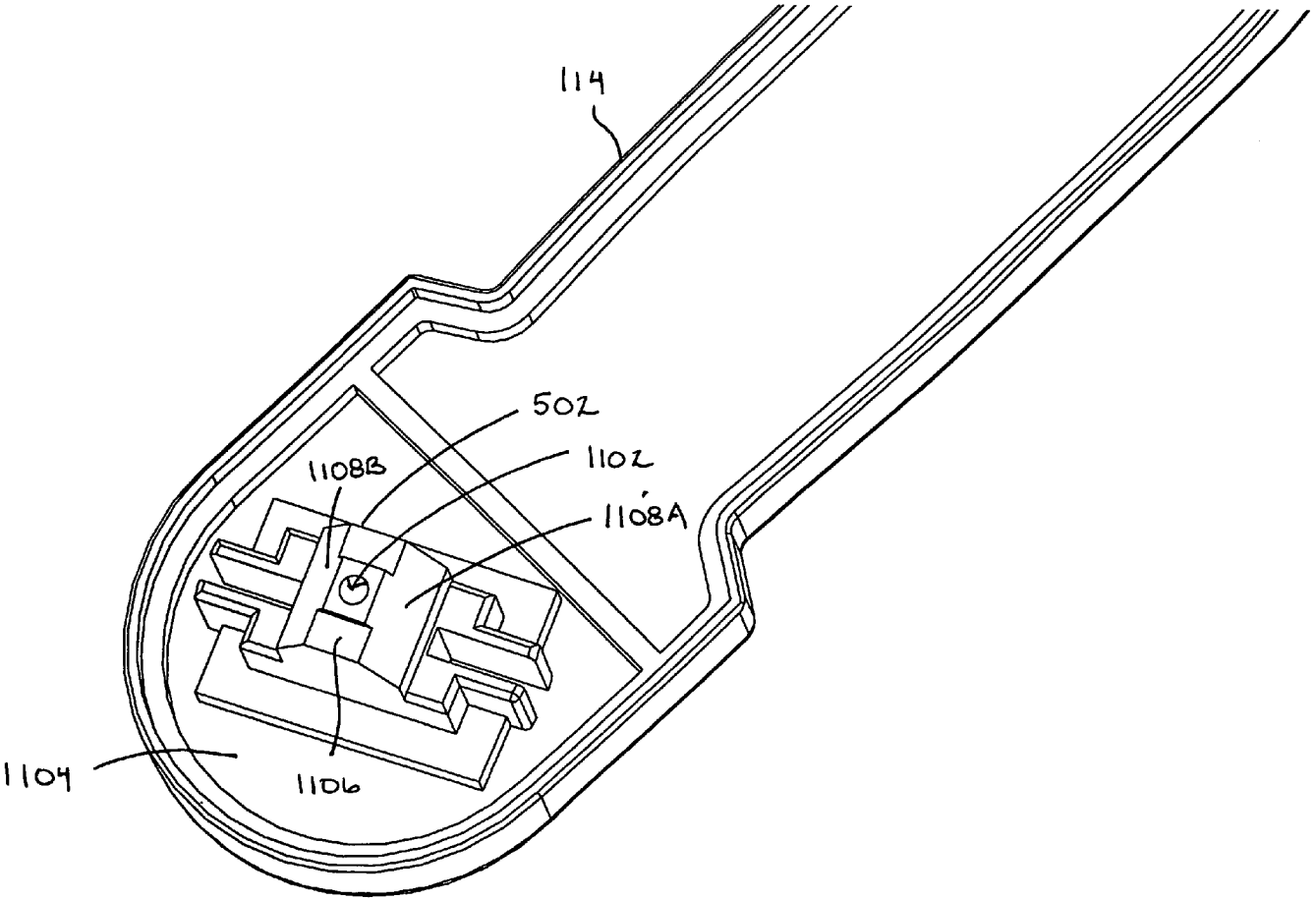
FIG. 11 illustrates an interior view of an upper housing for a security tag in accordance with one embodiment.

FIG. 11 illustrates an interior view of an upper housing for a security tag in accordance with one embodiment. FIG. 11 illustrates an interior view of upper housing 114 in greater detail. As shown in FIG. 11, abutment 502 is formed on upper housing inner surface 1104. In one embodiment, abutment 502 may comprise a flat bottom "V" shaped protrusion. More particularly, abutment 502 may comprise a flat bottom 1106 and angled walls 1108A and 1108B.

In one embodiment, the shape of abutment 502 may assist the detaching device in detaching clamp 406 from tack body 106 during the detachment operation. More particularly, the width of the flat bottom should be compatible with clamp 406 such that clamp 406 is bent properly to release tack body 106. Although a particular shape is shown for abutment 502, it may be appreciated that any shape may be suitable for a given implementation, as desired. For example, the shape of abutment 502 may be a post with the appropriate abutment aperture, or a curved structure without a flat bottom. The embodiments are not limited in this context.

In addition to assisting the detachment operation, the shape of abutment 502 may also provide a security feature for security tag 100. The flat bottom "V" shape of abutment 502 may limit the bend of clamp 406. This may reduce the possibility of someone successfully piercing one side of protrusion 124 with a foreign object in an attempt to push on clamp 406 to release tack body 106. In one embodiment, both sides of clamp 406 need to be bent a predetermined amount to release tack body 106.

In one embodiment, flat bottom 1106 and angled walls 1108A and 1108B may provide the above described advantages by assisting the detaching device to bend clamp 406 to an inside angle of 105 degrees. Some of these advantages, however, may also be obtained by having a shape that assists the detaching device in bending clamp 406 to an inside angle of 90 degrees, if a looser fit clamp 406 in clamp pocket 410 is acceptable for a given implementation. This may result, however, in tack assembly 102 having too much movement within security tag 100 for a desired implementation. The embodiments are not limited in this context.

In one embodiment, abutment 502 may further comprise an abutment aperture 1102. Abutment aperture 1102 may correspond to upper housing aperture 120, with a continuous hole between the two apertures.

In one embodiment, abutment 502 may be positioned on upper housing inner surface 1104 so that flat bottom 1106 may be above clamp aperture 1002 when upper housing 114 and lower housing 116 are melded together to form security tag 100. In this position, flat bottom 1106 of abutment 502 may provide resistance for clamp 406 when the driver rods are bending clamp 406 towards angled walls 1108A and 1108B to release tack body 106. Angled walls 1108A and 1108B may assist the driver rods to bend clamp 406 to the desired inside angle to release tack body 106 from clamp aperture 1002, for example. The embodiments are not limited in this context.

It is worthy to note that although the embodiments described herein refer to the use of a pair of driver rods during the detachment process, it can be appreciated that a single driver rod may be used and still fall within the scope of the embodiments. In this example, the shape of aperture 502 and height of clamp corner supports 902 may be adjusted such that clamp 406 may be bent by a single driver rod to a sufficient angle to release tack body 106. The embodiments are not limited in this context.

Figure 12:
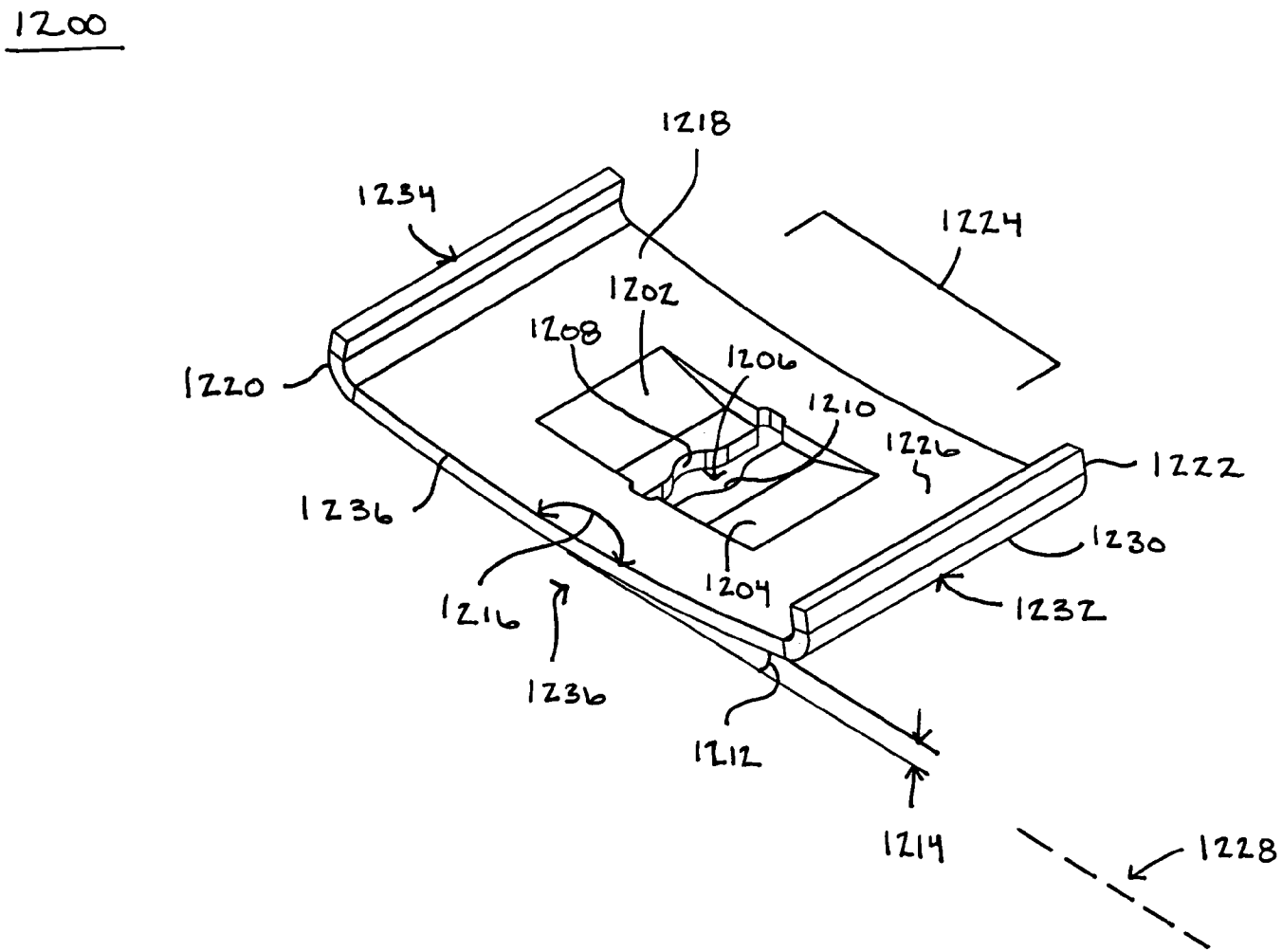
FIG. 12 illustrates a view of a clamp for a security tag in accordance with one embodiment.

FIG. 12 illustrates a view of a clamp for a security tag in accordance with one embodiment. FIG. 12 illustrates a clamp 1200 that may be representative of, for example, clamp 406. In one embodiment, clamp 1200 may be made of hardened steel. Other materials may be used for a particular implementation. The embodiments are not limited in this context.

In one embodiment, clamp 1200 may be approximately 0.375 inches long, 0.22 inches wide and 0.011 inches thick. These dimensions may be smaller than conventional clamps, and therefore result in a smaller and less expensive security tag.

In one embodiment, clamp 1200 may comprise a clamp body 1218. Clamp body 1218 may further comprise end portions 1232 and 1234, as well as a center portion 1236. End portions 1232 and 1234 may have clamp wings 1222 and 1220, respectively, which are an integral part of clamp body 1218. Center portion 1236 of clamp body 1218 may also comprise a tack retaining body 1224 that is an integral part of clamp body 1218. Tack retaining body 1224 may further comprise jaws 1202 and 1204. Jaws 1202 and 1204 each extend outwardly of the plane of clamp body 1218 to form an offset of approximately 0.025 inches, and then inwardly toward the other jaw. Jaws 1202 and 1204, furthermore, may terminate in facing edges 1208 and 1210, respectively. Facing edges 1208 and 1210 may together define a clamp aperture 1206 for receiving tack body 106. Clamp aperture 1206 may be, for example, circular or elliptical in shape. The embodiments are not limited in this context.

In one embodiment, tack assembly 102 may be restrained by clamp 1200 to complete the attachment operation. As discussed previously with reference to FIG. 2, pointed forward end 112 of tack body 106 may be inserted through article 202 during the attachment operation. Once pointed forward end 112 of tack body 106 is inserted through article 202, pointed forward end 112 may be inserted in a downward linear direction into upper housing aperture 120. Force may be applied to tack head 104 thereby moving tack body 106 through upper housing aperture 120. Upper housing aperture 120 may direct tack body 106 through clamp aperture 1206 defined by facing edges 1208 and 1210 of jaws 1202 and 1204, respectively. This causes jaws 1202 and 1204 to spread or open and allow tack body 106 to pass through clamp aperture 1206. When downward movement of tack assembly 102 is stopped at an appropriate groove 108, jaws 1202 and 1204 retract and clutch tack body 106. The appropriate groove 108 may be the groove that seats tack head 104 in concentric rampart 122 and thereby secures article 202 between tack head 104 and surface 136 of upper housing 114. Once seated, jaws 1202 and 1204 may prevent upward movement of tack assembly once they retract around the particular groove 108 since center portion 1236 of clamp

1200 is restrained within security tag 100 by abutment 502. In this manner, security tag 100 may be securely attached to article 202.

In one embodiment, clamp body 1218 may be curved to form a concave surface 1226 and a convex surface 1230. The amount of curve may vary according to a particular implementation. In one embodiment, for example, clamp body 1218 may be curved so that the distance between a line 1228 and one end of convex surface 1230 may be approximately 0.03 inches or an outside angle 1212 of approximately 8 degrees. Further, an inside angle 1216 as measured from the center of concave surface 1226 may be approximately 164 degrees. The embodiments are not limited to these metrics.

Outside angle 1212 and inside angle 1216 may be of particularly importance when releasing tack body 106 from clamp aperture 1206 of clamp 1200. During the detachment operation, the driver rods from detaching device 602 may make contact with clamp 1200. More particularly, a pair of driver rods may make contact with end portions 1232 and 1234 of clamp 1200, respectively. The driver rods may apply force to end portions 1232 and 1234 to bend clamp 1200. During this operation, center portion 1236 of clamp 1200 may make contact with abutment 502 to prevent clamp 1200 from moving upwards in response to the force applied by the driver rods. The driver rods may bend clamp 1200 to a release point. The term "release point" as used herein may refer to the degree a clamp is bent to release tack body 106 from clamp aperture 1206. For example, the release point may comprise an angle which spreads jaws 1202 and 1204 far enough apart to release tack body 106. The release point may vary in accordance with a number of factors, such as the size of the clamp body, clamp aperture, clamp material, clamp hardness, and so forth. The embodiments are not limited in this context.

In one embodiment, outside angle 1212 may be an angle that permits the contact surface of the driver rods to be sufficient to bend end portions 1232 and 1234 in the desired direction towards abutment 502. Once released, tack body 106 may be withdrawn from clamp aperture 1206, and tack assembly 102 may be withdrawn from security tag 100.

Outside angle 1212 and inside angle 1216 may be changed by the driver rods to attain the release point. In one embodiment, for example, inside angle 1216 may comprise an angle from a set of angles between 146–180 degrees prior to the detachment operation. The particular angle for inside angle 1216 should be sufficient to allow the driver rods to make contact with the ends of clamp 1200, and also facilitate moving the ends of clamp 1200 towards abutment 502. In one embodiment, for example, this may be accomplished by having an inside angle 1216 of approximately 164 degrees prior to the detachment operation. During the detachment operation, inside angle 1216 may be changed to a release point comprising an angle from a set of angles between 90–145 degrees, for example. The particular angle for the release point should be sufficient to allow removal of tack body 106, and also to assist in preventing unauthorized release of tack body 106 as discussed below. In one embodiment, for example, this may be accomplished by having a release point of approximately 130 degrees. Inside angle 1216 prior to the detachment operation, and the release point after the detachment operation, may vary considerable according to a given implementation. The embodiments are not limited in this context.

In one embodiment, the clamp 1200 may also have a yield point. The term "yield point" as used herein may refer to the degree a clamp may be bent to become permanently deformed or unable to return to its original form. The yield point may vary in accordance with a number of factors, such as the size of the clamp body, clamp aperture, clamp material, clamp hardness, and so forth. The embodiments are not limited in this context.

Clamp 1200 may be made of any type of flexible material with sufficient hardness to adequately retain tack body 106, yet flexible enough to bend to the release point and/or yield point. In one embodiment, the detachment operation may bend clamp 1200 to its yield point or beyond, thereby preventing reuse of clamp 1200. In one embodiment, the detachment may bend clamp 1200 to its release point, but not its yield point, thereby allowing for the repeated use of clamp 1200. The embodiments are not limited in this context.

The particular type of clamp used for a given implementation may vary according to a number of factors, such as whether the security tag is designed to be disposable or reused, the level of force desired to prevent manual pull out of tack body 106 from the clamp, the level of security desired to prevent "defeats" or unauthorized removal of tack body 106 from security tag 100, and so forth. The embodiments are not limited in this context.

In one embodiment, clamp 1200 may have clamp wings 1220 and 1222. Clamp wings 1220 and 1222 may assist in orienting clamp 1200 within clamp pocket 410 during the assembly process. For example, the clamp wings 1220 and 1222 may ensure that convex surface 1230 is positioned towards the bottom of clamp pocket 410 and away from abutment 502. This facilitates retaining tack body 106 during the attachment operation, and releasing tack body 106 during the detachment operation. If convex surface 1230 was positioned towards abutment 502, for example, the release point and/or yield points may not necessarily remain valid. The curved outer surfaces of clamp wings 1220 and 1222 may also provide better contact with clamp supports 902, for example.

It is worthy to note that although clamp body 1218 is shown as curved in this description, it may be appreciated that clamp body 1218 may also be substantially straight and still fall within the scope of the embodiments. In this case, however, some elements of security tag 100 may need to be modified, such as the angle for the driver rods, features of abutment 502, and so forth. The embodiments are not limited in this context.

Figure 13:
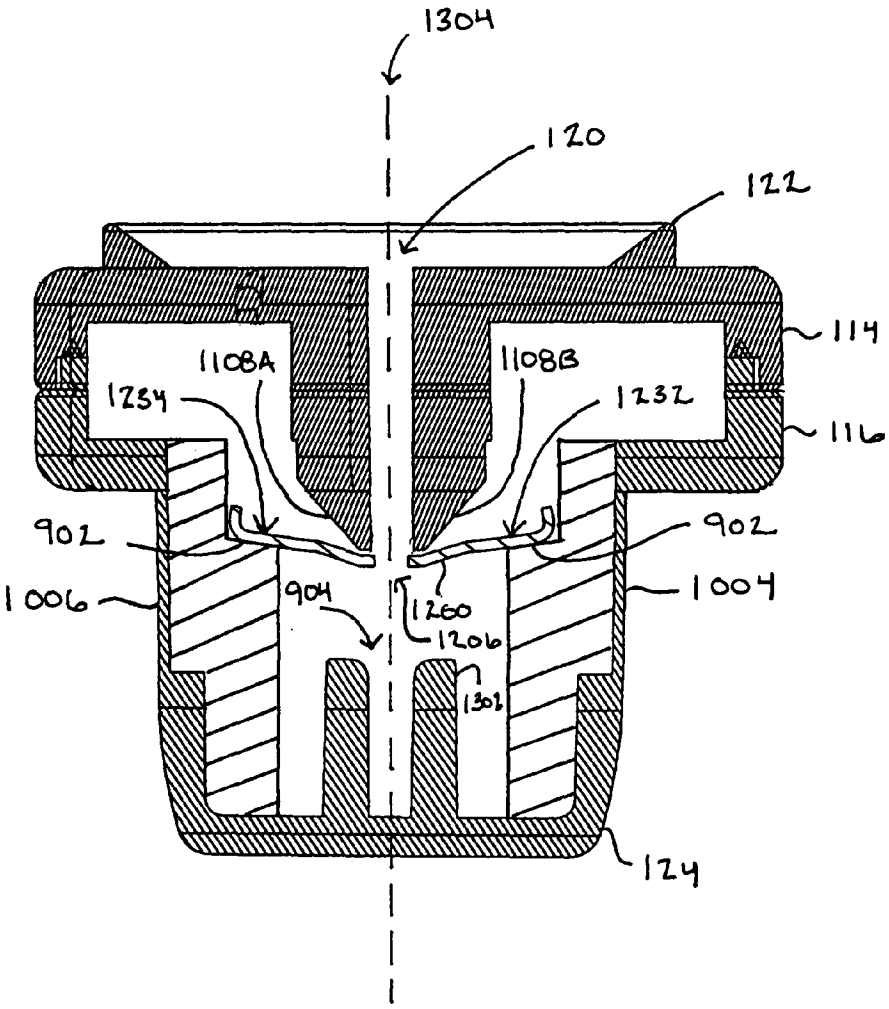
FIG. 13 illustrates a view of a cross-section taken along line A—A (from FIG. 1) of a security tag and a clamp in a first position in accordance with one embodiment.

FIG. 13 illustrates a view of a cross-section taken along line A—A of a security tag and a clamp in a first position in accordance with one embodiment. FIG. 13 illustrates a cross-section taken along line A—A of security tag 100 with clamp 1200 inserted into clamp pocket 410. As shown in FIG. 13, when upper housing 114 and lower housing 116 are melded together to form security tag 100, upper surface aperture 120, clamp aperture 1206 and lower housing aperture 904 are aligned along line 1304. This facilitates insertion of tack body 106 into security tag 100 through upper housing aperture 120 until pointed forward end 112 seats in lower housing aperture 904. Further, clamp 1200 may be constrained in position between abutment 502 and clamp corner supports 902. Lateral movement of clamp 1200 normal to tack body 106 may be controlled by clamp pocket 410 formed in protrusion 124. This may hold alignment of upper housing aperture 120 and abutment aperture 1102 with clamp aperture 1206. Location of clamp 1200 perpendicular to tack body 106 may be controlled by clamp corner supports 902. Abutment 502 may constrain clamp 1200 from moving off clamp corner supports 902 by having flat bottom 1106 of abutment 502 rest upon center portion 1236 of clamp 1200.

FIG. 13 may also illustrate clamp 1200 positioned so that end portions 1234 and 1232 may be bent by the driver rods towards angled walls 1108A and 1108B, respectively. Angled walls 1108A and 1108B may assist the driver rods to bend clamp 1200 to the desired angle to release tack body 106 from clamp aperture 1002.

Figure 14:
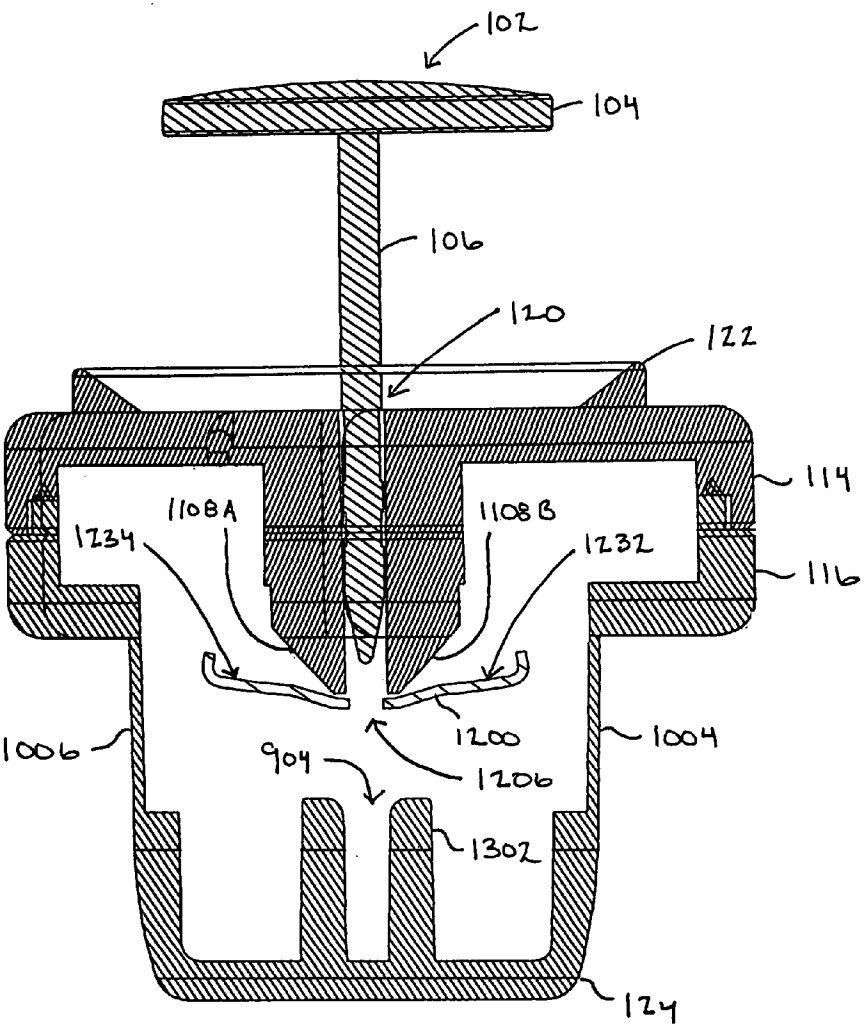
FIG. 14 illustrates a first view of a cross-section taken along line A—A of a security tag with a tack in accordance with one embodiment.

FIG. 14 illustrates a first view of a cross-section taken along line A—A of a security tag with a tack in accordance with one embodiment. FIG. 14 illustrates a cross-section taken along line A—A of security tag 100 with clamp 1200 inserted in clamp pocket 410, and tack assembly 102 partially inserted into upper housing aperture 120. When tack body 106 is pushed through upper housing aperture 120, pointed forward end 112 of tack body 106 is aligned to go through clamp aperture 1206. Further insertion of tack body 106 causes pointed forward end 112 and clamp aperture 1206 to further align.

Figure 15:
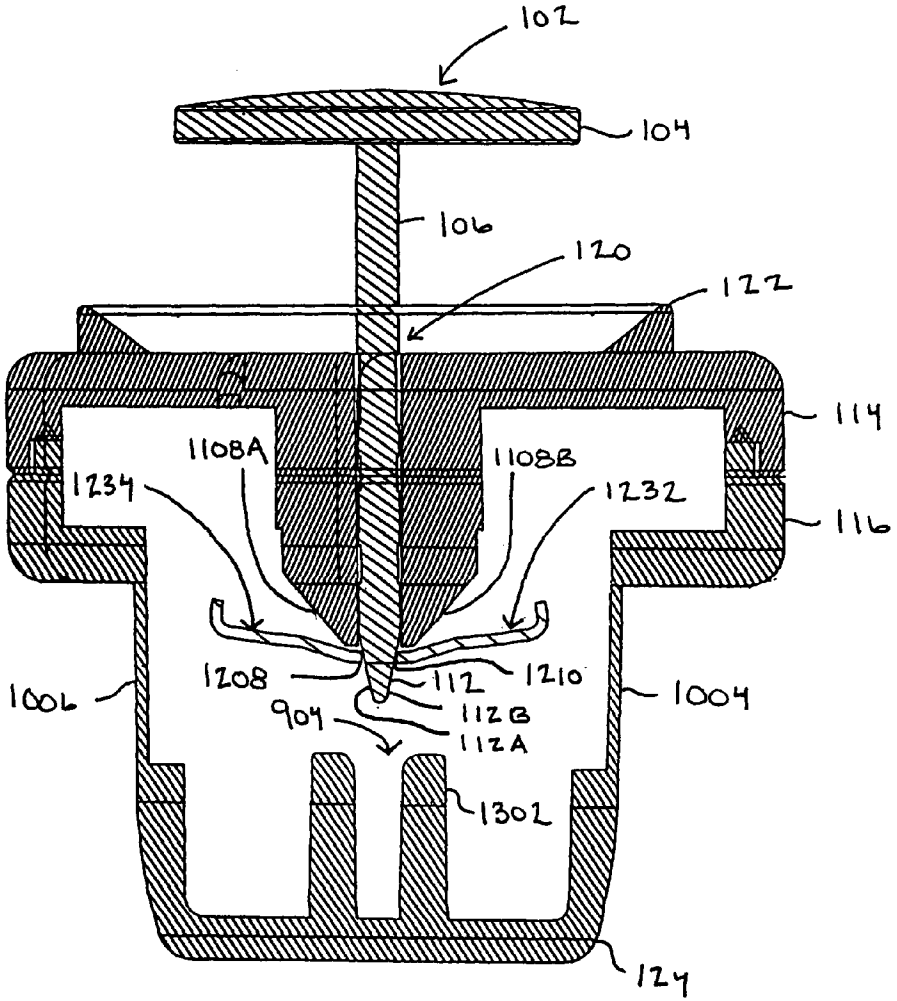
FIG. 15 illustrates a second view of a cross-section taken along line A—A of a security tag with a tack in accordance with one embodiment.

FIG. 15 illustrates a second view of a cross-section taken along line A—A of a security tag with a tack in accordance with one embodiment. FIG. 15 illustrates a cross-section taken along line A—A of security tag 100 with clamp 1200 inserted in clamp pocket 410, tack body 106 partially inserted into upper housing aperture 120, and pointed forward end 112 partially inserted into clamp aperture 1206. As shown in FIG. 15, further insertion of tack body 106 causes edges 112A and 112B of the conical shape of pointed forward end 112 to bear against edges 1208 and 1210, respectively. Pointed forward end 112 forces clamp aperture 1206 to enlarge by causing jaws 1202 and 1204 to flex against their bias until pointed forward end 112 goes through clamp aperture 1206.

Figure 16:
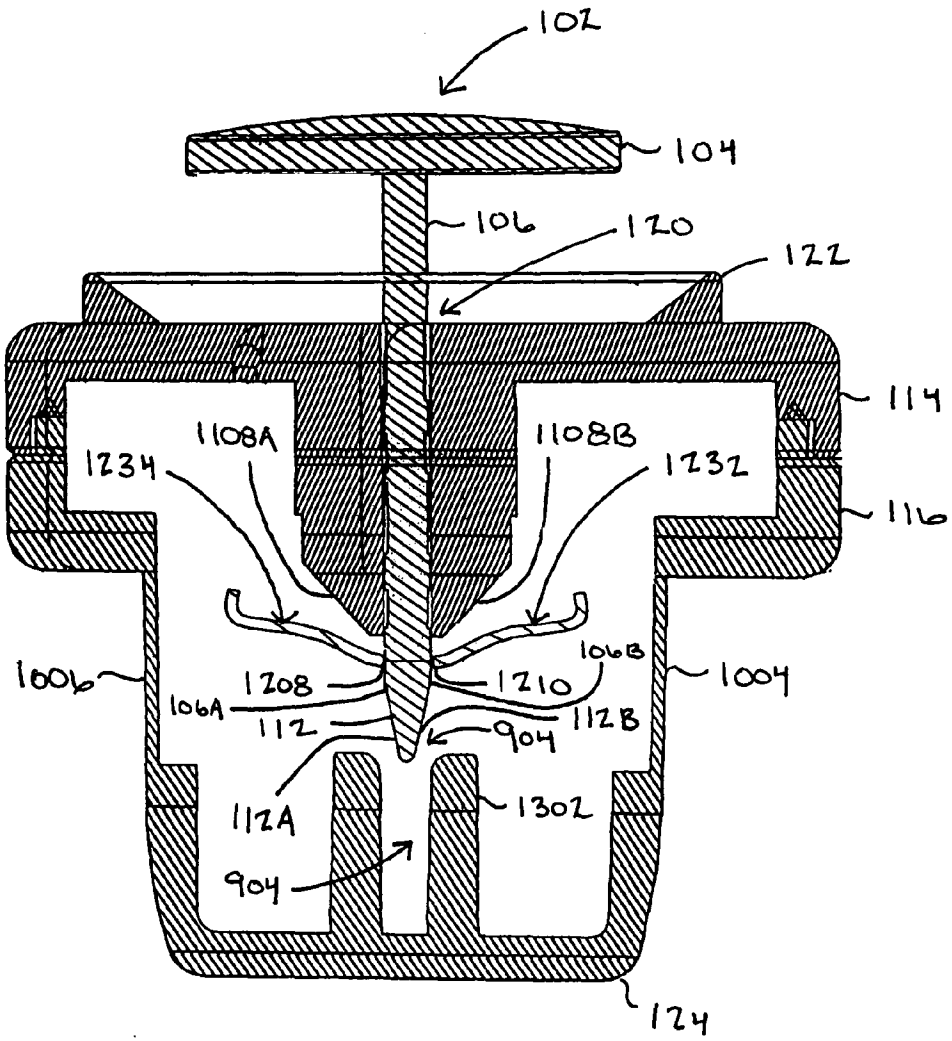
FIG. 16 illustrates a third view of a cross-section taken along line A—A of a security tag with a tack in accordance with one embodiment.

FIG. 16 illustrates a third view of a cross-section taken along line A—A of a security tag with a tack in accordance with one embodiment. FIG. 16 illustrates a cross-section taken along line A—A of security tag 100 with clamp 1200 inserted in clamp pocket 410, tack body 106 partially inserted into upper housing aperture 120, and tack body 106 partially inserted into clamp aperture 1206. As shown in FIG. 16, further insertion causes tack body 106 to begin sliding through clamp aperture 1206. The insertion causes surfaces 106A and 106B to contact edges 1208 and 1210, respectively. This causes jaws 1202 and 1204 to flex against their bias to a maximum amount during the insertion operation.

Figure 17:
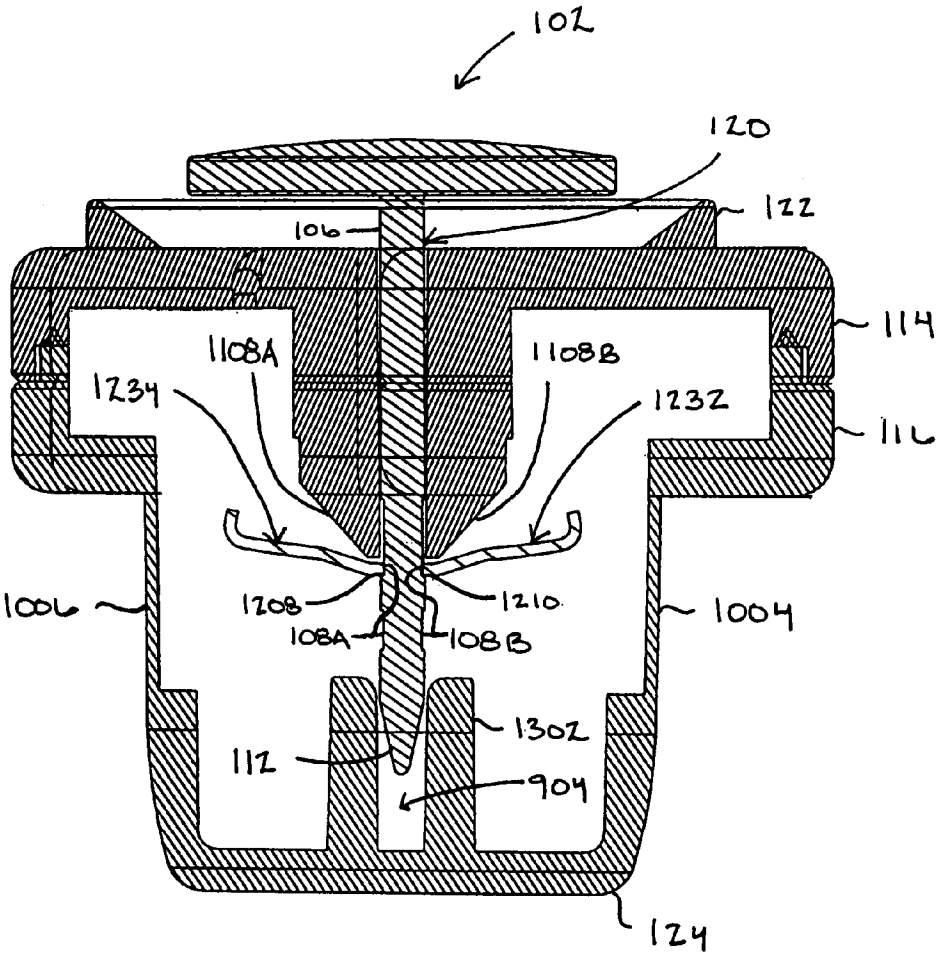
FIG. 17 illustrates a fourth view of a cross-section taken along line A—A of a security tag with a tack in accordance with one embodiment.

FIG. 17 illustrates a fourth view of a cross-section taken along line A—A of a security tag with a tack in accordance with one embodiment. FIG. 17 illustrates a cross-section taken along line A—A of security tag 100 with clamp 1200 inserted in clamp pocket 410, tack body 106 fully inserted into upper housing aperture 120, and tack body 106 fully inserted into clamp aperture 1206 until an appropriate tack groove 108 is reached. As shown in FIG. 17, the insertion of tack body 106 through clamp aperture 1206 may continue until a first tack groove 108 is reached, which allows the bias of jaws 1202 and 1204 to close clamp aperture 1206 about tack groove 108. The closure may cause edges 1208 and 1210 to make contact with surfaces 108A and 108B of tack groove 108, respectively. Tack body 106 may be further inserted into clamp aperture 1206 until a second tack groove 108 is reached. This may continue for any number of tack grooves 108, depending upon the thickness of article 202. Eventually, tack head 104 will seat in concentric rampart 122, and article 202 will be securely attached between tack head 104 and surface 136 of upper housing 114. In addition, pointed forward end 112 will eventually be received by lower housing aperture 904.

It is worthy to note that the amount of flexing of clamp 1200, and jaws 1202 and 1204, needed to insert tack body 106 through clamp aperture 1206 until reaching an appropriate tack groove 108, does not cause the clamp to permanently deform or reach its yield point. The amount of force needed to fully insert tack assembly 102 into security tag 100 as shown in FIG. 17 is approximately 5–10 pounds, depending upon a particular implementation as discussed previously. The amount of force needed to pull tack assembly 102 from security tag 100 as shown in FIG. 17 may be approximately 80–125 pounds. A direct pull-out force of approximately 80 pounds, for example, should be sufficient to prevent unauthorized removal for most applications.

Figure 18:
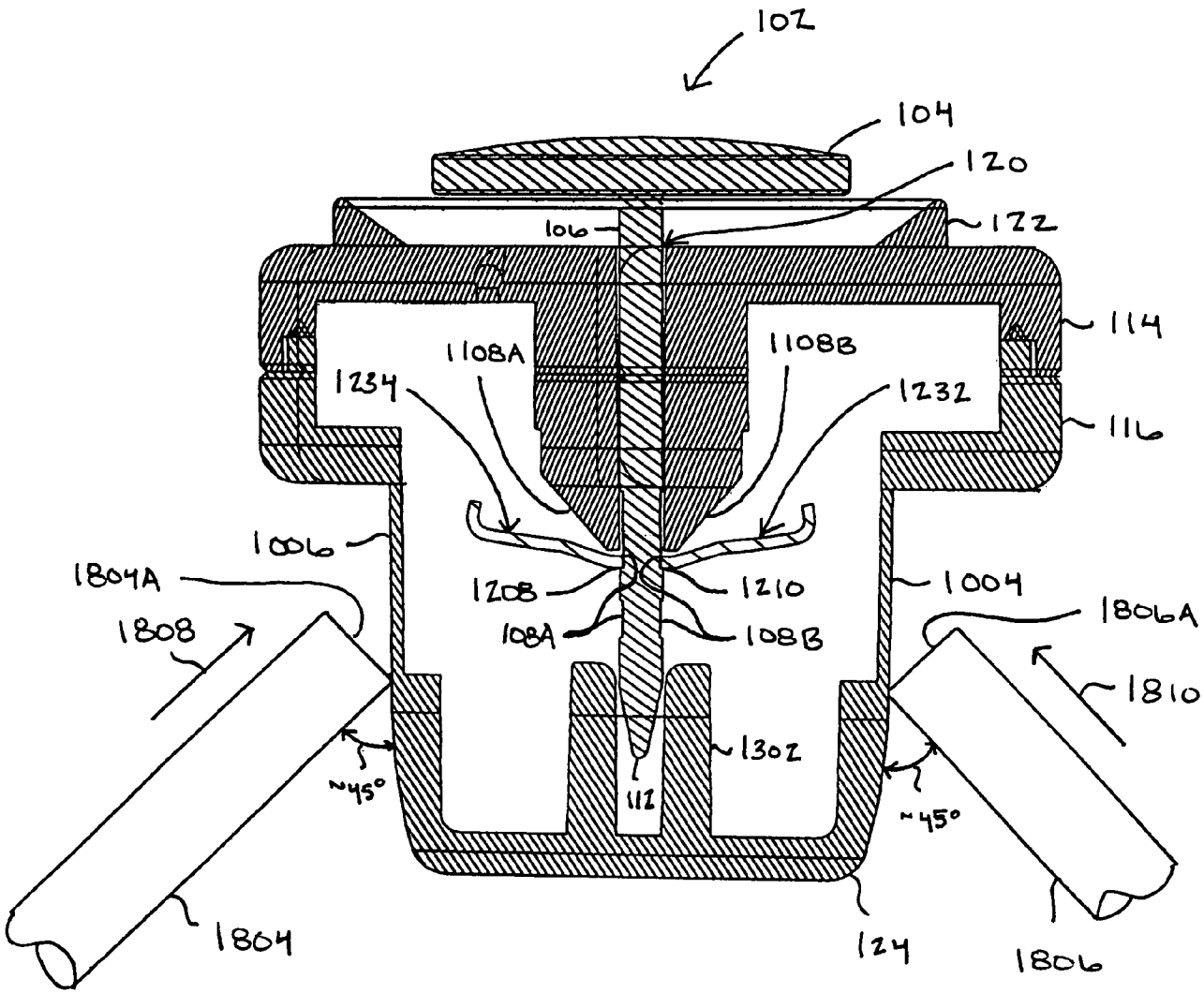
FIG. 18 illustrates a first view of a cross-section taken along line A—A of a security tag with a tack and driver rods in accordance with one embodiment.

FIG. 18 illustrates a first view of a cross-section taken along line A—A of a security tag with a tack and driver rods in accordance with one embodiment. FIG. 18 illustrates a cross-section taken along line A—A of security tag 100 with tack body 106 fully inserted into clamp aperture 1206 until a tack groove 108 is reached, and a pair of driver rods 1804 and 1806 positioned to move towards access walls 1006 and 1004, respectively.

In one embodiment, clamp 1200 is bent past its yield point in order to release tack body 106 from clamp aperture 1206. Since clamp 1200 is bent past its yield point, it does not fully return to its initial shape. This characteristic makes security tag 100 in general, and clamp 1200 in particular, useful for only a single application. Other characteristics of security tag 100 may also make it useful for only a single application, such as the deforming of outer wall 134 during the detachment operation, for example.

In one embodiment, inside angle 1216 should move from approximately 164 degrees to 130 degrees to allow tack body 106 to be free for removal. Due to some measure of spring return bias remaining in clamp 1200 despite being bent beyond its yield point, inside angle 1216 should be moved to approximately 105 degrees in order for clamp 1200 to stay below 130 degrees once the bending force is removed. Bending clamp 1200 to an inside angle 1216 of only 164 to 130 degrees may leave some pull-out resistance against tack body 106, although this may be tolerable for some applications.

In one embodiment, clamp 1200 may be bent using driver rods 1804 and 1806. Driver rods 1804 and 1806 may be made of hardened steel, typically 0.093 inches in diameter. Ends 1804A and 1806A of driver rods 1804 and 1806, respectively, may be shaped to reduce the amount of force needed to penetrate outer wall 134 of protrusion 124, and yet still hold engagement with the circular shape and surface of outer wall 134. The shape of driver rod ends 1804A and 1806A are not limited in this context, as long as they are capable of penetrating outer wall 134.

In one embodiment, driver rods 1804 and 1806 may penetrate outer wall 134 at approximately a 45 degree angle relative to tack body 106. The embodiments are not limited in this context. For example, driver rods 1804 and 1806 may penetrate outer wall 134 at other angles and engage clamp end portions 1232 and 1234, respectively. The 45 degree angle, however, may provide several advantages over other possible angles.

In one embodiment, the 45 degree angle may facilitate penetration. For example, the 45 degree angle may reduce the contact area between driver rod ends 1804A and 1806A and access walls 1006 and 1004, respectively. The reduced contact area may facilitate cutting through access walls 1006 and 1004. By way of contrast, an angle closer to 90 degrees may increase the contact area, thereby requiring more force to penetrate the access walls.

In one embodiment, the 45 degree angle may also facilitate the bending of clamp 1200. For example, the 45 degree angle may reduce the movement of the contact point between driver rod ends 1804A and 1806A and clamp end portions 1232 and 1234, respectively, thereby creating a more secure engagement between the rod ends and clamp ends. Other angles closer to 90 degrees may increase the movement between driver rod ends 1804A and 1806A and clamp end portions 1232 and 1234, thereby decreasing the engagement.

In one embodiment, the 45 degree angle may also reduce the vertical movement of jaws 1202 and 1204. The vertical force/movement caused by angles greater than 45 degrees may increase the possibility of jaws 1202 and 1204 pulling tack body 106 further into security tag 100, thereby causing a binding action that may require a much greater force to release tack body 106 from clamp aperture 1206.

Referring again to FIG. 18, clamp 1200 is bent by driver rods 1804 and 1806. The detachment operation causes driver rods 1804 and 1806 to thrust in towards opposite sides of outer wall 134 of protrusion 124. The movement continues up to access walls 1006 and 1004, respectively, in thrust directions 1808 and 1810, respectively.

Figure 19:
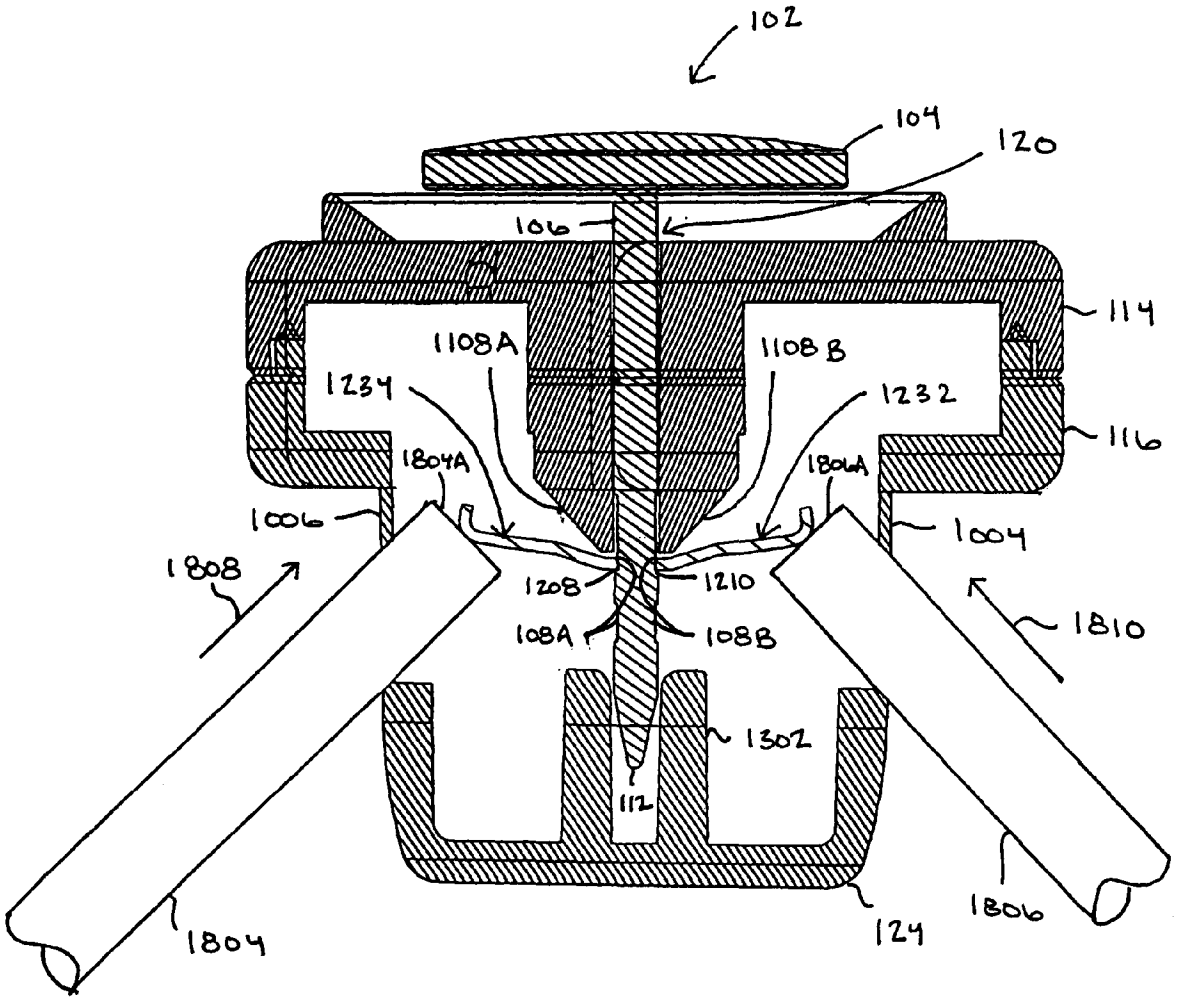
FIG. 19 illustrates a second view of a cross-section taken along line A—A of a security tag with a tack and driver rods in accordance with one embodiment.

FIG. 19 illustrates a second view of a cross-section taken along line A—A of a security tag with a tack and driver rods in accordance with one embodiment. FIG. 19 illustrates a cross-section taken along line A—A of security tag 100 with driver rods 1804 and 1806 penetrating access walls 1006 and 1004, respectively. As shown in FIG. 19, driver rods 1804 and 1806 proceed through access walls 1006 and 1004 until contact is made between driver rod end 1804A and clamp end portion 1234, and driver rod end 1806A and clamp end portion 1232.

Figure 20:
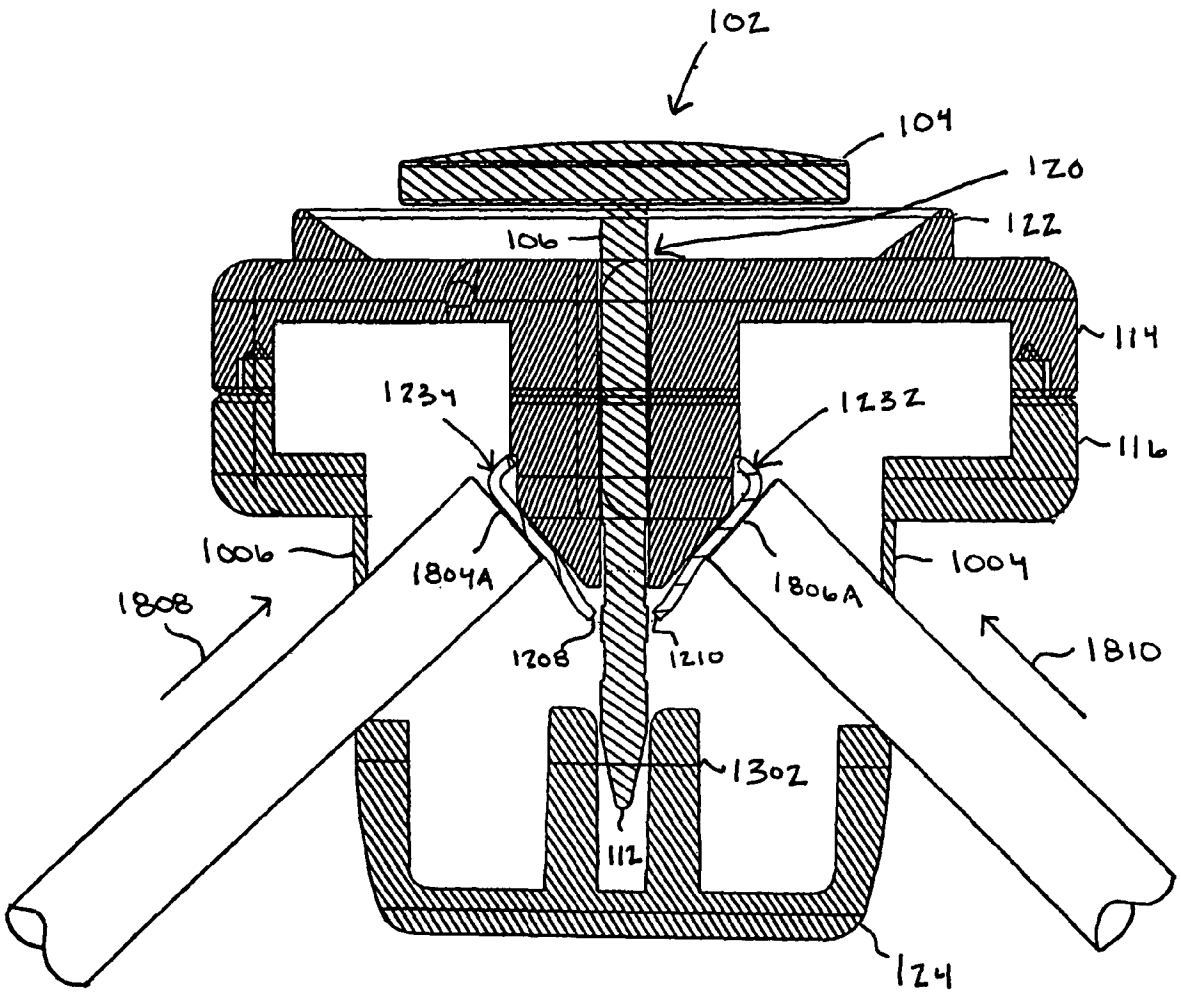
FIG. 20 illustrates a third view of a cross-section taken along line A—A of a security tag with a tack and driver rods in accordance with one embodiment.

FIG. 20 illustrates a third view of a cross-section taken along line A—A of a security tag with a tack and driver rods in accordance with one embodiment. FIG. 20 illustrates a cross-section taken along line A—A of security tag 100 with driver rods 1804 and 1806 penetrating access walls 1006 and 1004, respectively. As shown in FIG. 20, driver rods 1804 and 1806 continue to apply force against clamp end portions 1234 and 1232, respectively, and bend clamp 1200 around abutment 502 until clamp end portion 1234 makes contact with angled wall 1108A and clamp end portion 1232 makes contact with angled wall 1108B. In the shown position, clamp 1200 is bent beyond its yield point, and inside angle 1216 may be approximately 90 degrees, although the embodiments are not limited in this context. At this point, tack body 106 is released from clamp aperture 1206, and may be withdrawn if desired.

Figure 21:
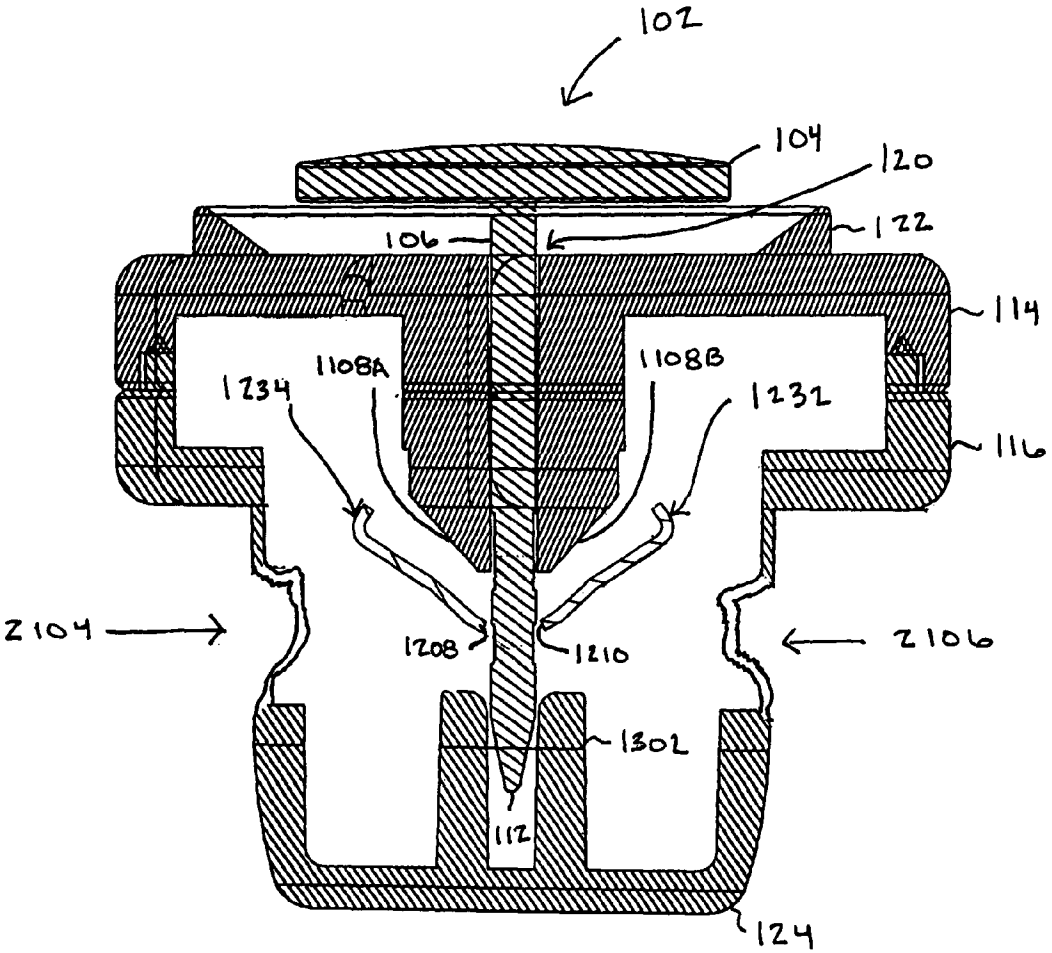
FIG. 21 illustrates a view of a cross-section taken along line A—A of a security tag and with a tack and a clamp in a second position in accordance with one embodiment.

FIG. 21 illustrates a view of a cross-section taken along line A—A of a security tag and with a tack and a clamp in a second position in accordance with one embodiment. FIG. 21 illustrates a cross-section taken along line A—A of security tag 100 with tack assembly 102 still inserted after the tack release operation is completed. When tack body 106 has been released from clamp aperture 1206, driver rods 1804 and 1806 may be withdrawn from lower housing 116. Lower housing 116 may have apertures 2104 and 2106 after the withdrawal operation is complete. Apertures 2104 and 2106 indicate that security tag 100 has been used.

It is worthy to note that apertures 2104 and 2106 may be preformed as open apertures into outer wall 134, thereby reducing or eliminating the need to penetrate outer wall 134 using the driver rods to access clamp 1200. This may, however, provide easier access to clamp 1200 and act as a guide for unauthorized release, thereby making security tag 100 less secure.

Figure 22:
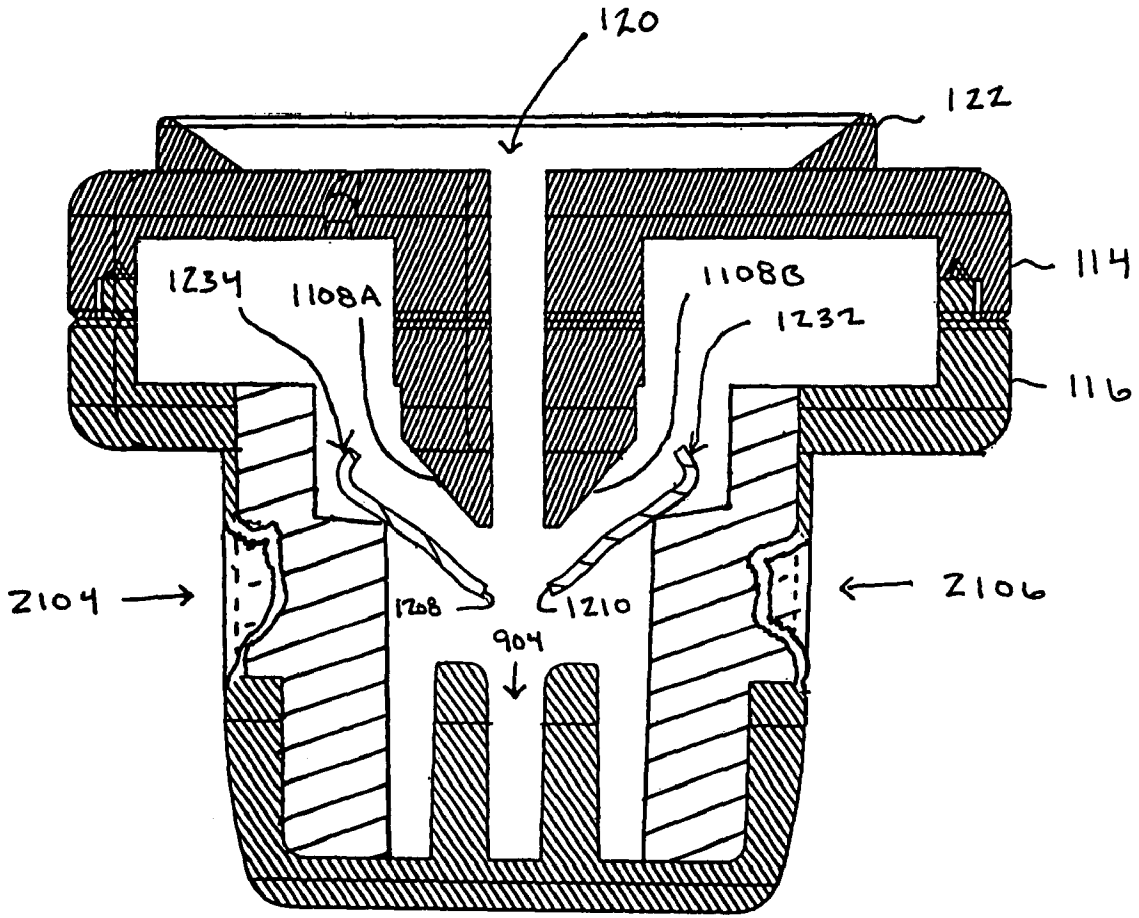
FIG. 22 illustrates a view of a cross-section taken along line A—A of a security tag and with a clamp in a second position in accordance with one embodiment.

FIG. 22 illustrates a view of a cross-section taken along line A—A of a security tag and with a clamp in a second position in accordance with one embodiment. FIG. 22 illustrates a cross-section taken along line A—A of security tag 100 with tack assembly 102 removed after the tack release operation is completed. As shown in FIG. 22, after completion of the detachment operation, clamp 1200 is permanently bent to approximately 114 degrees so it will be unable to retain tack body 106 if inserted. A release point of 114 degrees may be greater than needed for a given implementation, but ensures no further tack retention.

Figure 23:
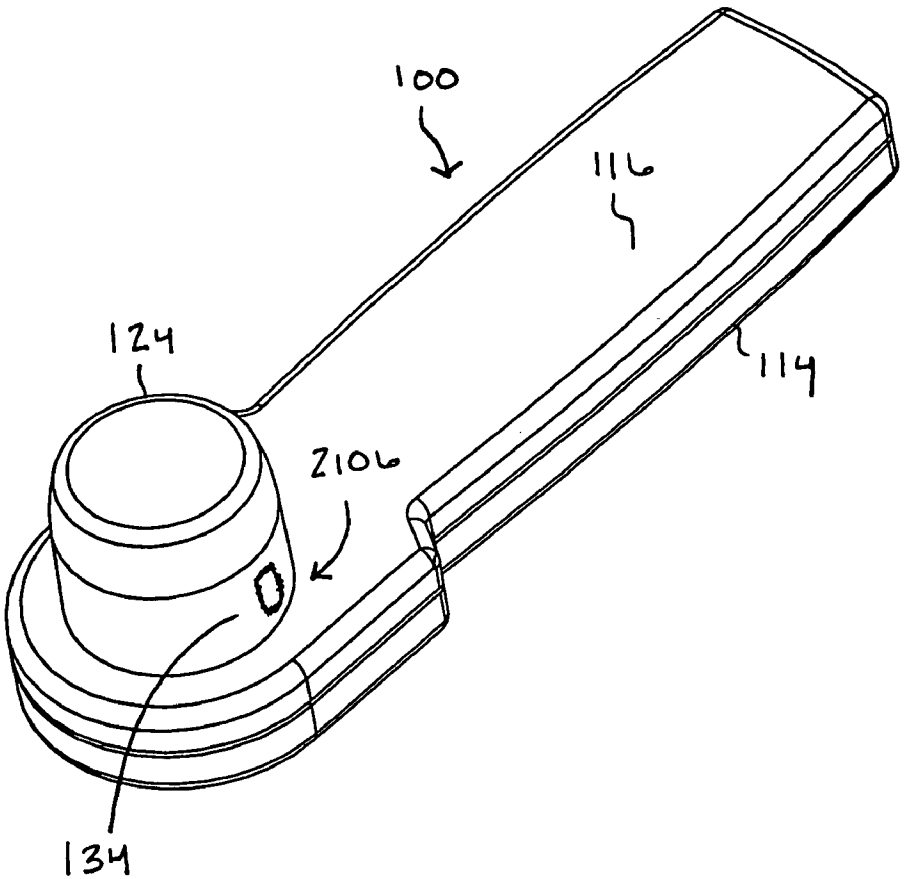
FIG. 23 illustrates an exterior view of a lower housing for a security tag in accordance with one embodiment.

FIG. 23 illustrates an exterior view of a lower housing for a security tag in accordance with one embodiment. FIG. 23 illustrates an exterior view of lower housing 116 of security tag 100 after the detachment operation is completed. As shown in FIG. 23, aperture 2106 is visible evidence that security tag 100 has been used, and therefore security tag 100 may be discarded or recycled.

Figure 24:
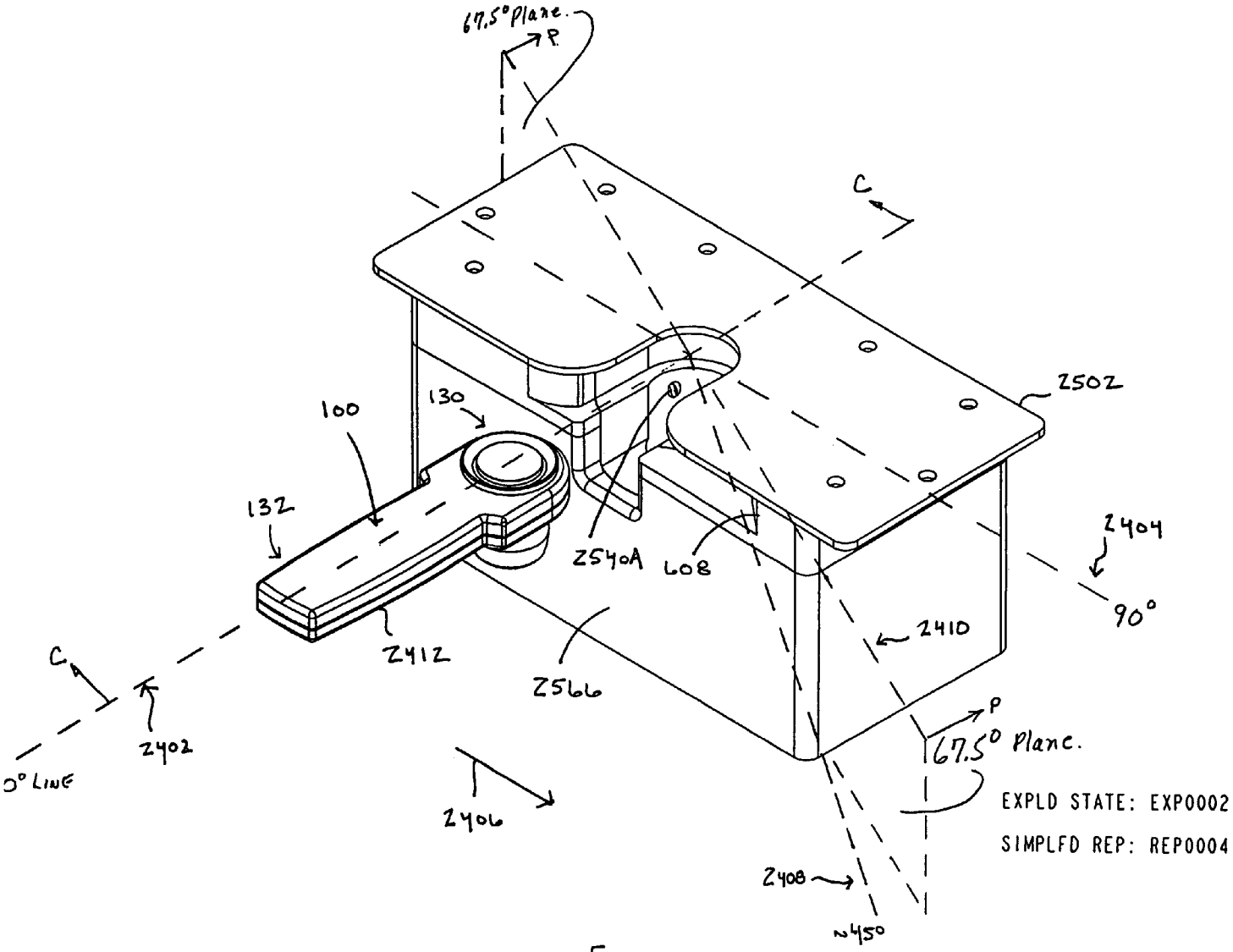
FIG. 24 illustrates a security tag being inserted into a detaching device in accordance with one embodiment.

FIG. 24 illustrates a security tag being inserted into a detaching device in accordance with one embodiment. FIG. 24 illustrates detaching device 602 in greater detail. As shown in FIG. 24, first end 130 of security tag 100 may be inserted into detaching device 602 in the first position, such that second end 132 is along line 2402 which is perpendicular to the edge of the detaching device represented by line 2404. Line 2402 may be a reference line of 0 degrees, and line 2404 may represent a 90 degree shift from reference line 2402.

In one embodiment, force may be applied to second end 132 in direction 2406 to move second end 132 from the first position to the second position. The force applied to second end 132 may continue until it reaches the second position, which may or may not cause relief side 2412 of security tag 100 to make contact with edge 608 of detaching device 602. Second end 132 should be approximately along line 2408 in the second position. Line 2408 may represent approximately a 45 degree shift relative to the reference line 2402.

In one embodiment, offset 414 as discussed with reference to FIG. 1 may allow a greater degree of movement between the first position and the second position for second end 132. In one embodiment, offset 414 may be on both sides of security tag 100. In another embodiment, offset 414 may be on one side of security tag 100. For example, the one side may be relief side 2412.

In one embodiment, the movement of second end 132 from the first position to the second position releases tack body 106 of tack assembly 102 from clamp 1200. The movement causes one or more driver rods to move towards outer wall 134 of protrusion 124. The driver rods penetrate outer wall 134 of protrusion 124 to access clamp 1200. In one embodiment, for example, the amount of force needed to penetrate outer wall 134 may be approximately 7 pounds of force. The driver rods bend clamp 1200 against abutment 502 beyond a yield point for clamp 1200, which releases the tack body. Once tack body 106 is released from clamp 1200, second end 132 may be moved from the second position back to the first position. This movement withdraws the driver rods from outer wall 134 of protrusion 124. Security tag 100 may then be removed from detaching device 602. After the detachment operation, protrusion 124 may have one or more holes or apertures through outer wall 134.

Figure 25:
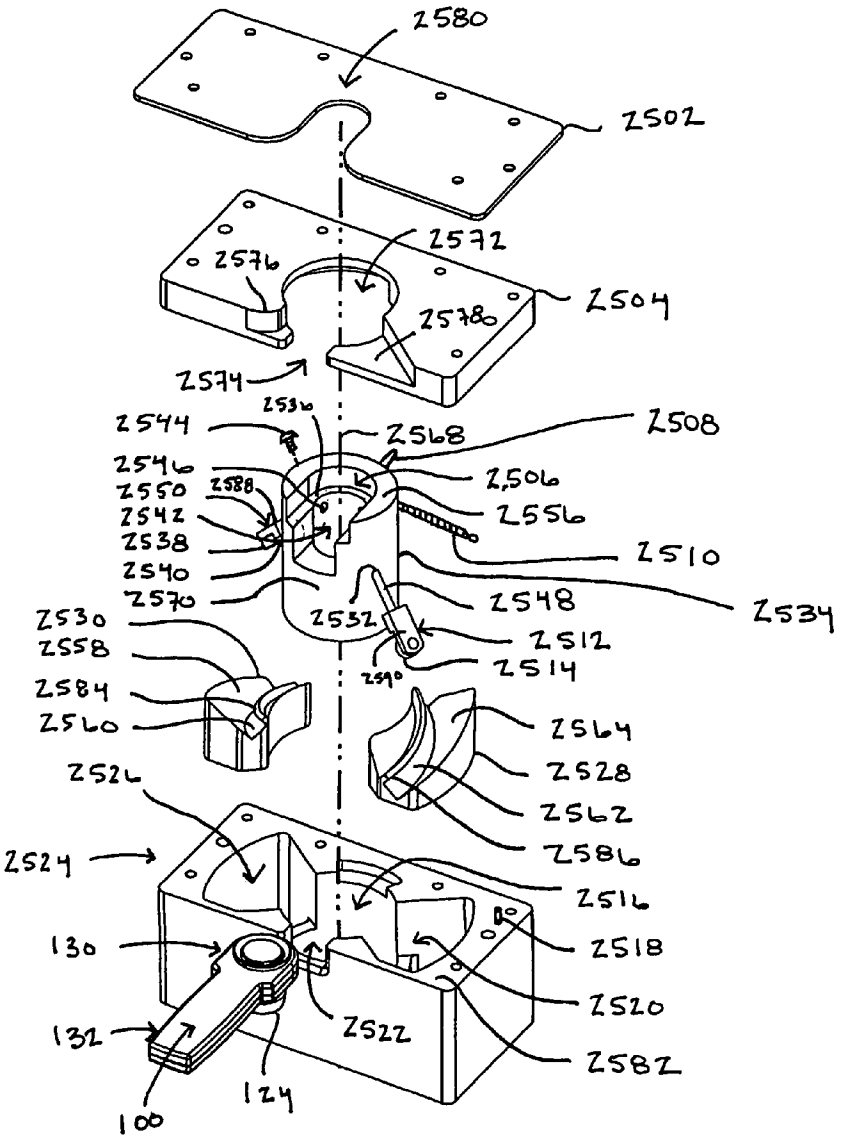
FIG. 25 illustrates an exploded view of a detaching device in accordance with one embodiment.

FIG. 25 illustrates an exploded view of a detaching device in accordance with one embodiment. FIG. 25 illustrates an exploded view of detaching device 602. In one embodiment, for example, detaching device 602 may comprise a housing 2524, curved ramps 2528 and 2530, a rotor 2534, a cover 2504, a cover plate 2502, driver rods 2540 and 2548, and various mounting screws.

In one embodiment, detaching device 602 may also include a bezel, such as bezel 610 described with reference to FIG. 6. It may be appreciated, however, that any bezel may be used to finish detaching device 602.

In one embodiment, rotor 2534 may further comprise a nest 2506, a rotor return spring 2510, a rotor return spring pin 2518, driver rod apertures 2532 and 2546, a rotor shoulder 2536 a rotor concentric aperture 2542, and a rotor return spring screw 2544.

In one embodiment, driver rods 2540 and 2548 may have any shape to facilitate penetration or insertion through outer wall 134. For example, driver rods 2540 and 2548 may be cylindrical, rectangular, triangular, octagonal, and so forth. The embodiments are not limited in this context. Further, driver rods 2540 and 2548 each have a first end and a second end. The first end may comprise a wedge shaped tip to help penetrate the access walls. The shape of the first end may be any shape desired to facilitate penetrating the access walls, and the embodiments are not limited in this context. The second end may comprise a bearing assembly, such as bearing assemblies 2512 and 2550. Bearing wheels 2514 and 2538 may be attached to bearing assemblies 2512 and 2550, respectively.

Figure 26:
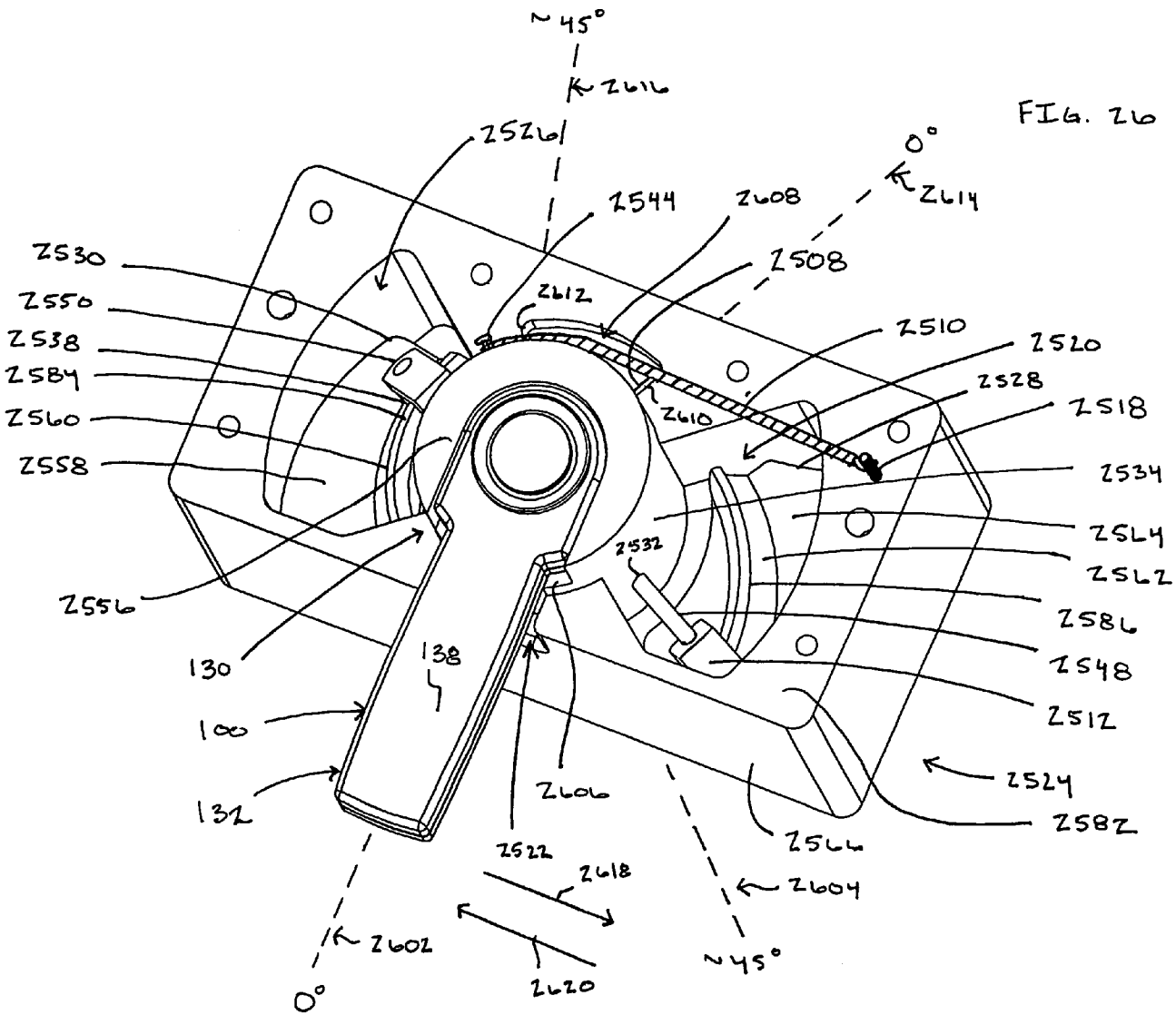
FIG. 26 illustrates an interior view of a detaching device and an inserted security tag in a first position in accordance with one embodiment.

FIG. 26 illustrates an interior view of a detaching device and an inserted security tag in a first position in accordance with one embodiment. FIG. 26 illustrates detaching device 602 partially assembled with cover plate 2502, cover 2504 and bezel 610 removed. It also illustrates first end 130 of security tag 100 inserted into detaching device 602.

As shown in FIG. 26, when assembled ramp pockets 2526 and 2564 receive curved ramps 2530 and 2528, respectively. Rotor cylindrical aperture 2516 receives rotor 2534. Driver rods 2540 and 2548 are inserted into driver rod apertures 2546 and 2532, respectively. Bearing wheels 2538 and 2514 rest on up ramp surfaces 2558 and 2564, respectively. Rotor return spring 2510 is attached to rotor return spring screw 2544 at one end, and rotor return spring pin 2518 on the other end. One function of the rotor return spring is to bias rotor 2534 to the first position, to prepare it for the detachment operation, for example. Rotor stop pin 2508 may be positioned within a rotor pin channel 2608. Cover 2504 is mounted to housing top surface 2582 using mounting screws or some other fastening mechanisms. Cover plate 2502 is mounted to cover 2504 using mounting screws or some other fastening mechanisms. A bezel, such as bezel 610, may be mounted to cover plate 2502.

In one embodiment, rotor stop pin 2508 may be positioned within rotor pin channel 2608 to assist in limiting rotation of second end 132 and rotor 2534. When second end 132 is in the first position along line 2602, rotor stop pin 2508 may be at a first end 2610. First end 2610 may have a rotor stop pin reference angle of 0 degrees along line 2614. When second end 132 is moved to the second position, rotor stop pin may make contact with a second end 2612, thereby limiting further movement of second end 132 and rotor 2534. Second end 2612 may have an angle of approximately 45 degrees from the rotor stop pin reference angle along line 2616.

In one embodiment, housing 2524 is a substantially rectangular structure. Housing 2524 may have a housing front face 2566 with a width of approximately 6 inches, a height of approximately 1.5 inches, and a depth of approximately 3 inches. Housing front face 2566 may have a housing aperture 2522 adjacent to rotor 2534 to allow protrusion 124 to slide through directly into nest 2506. Top surface 138 of upper housing 114 is approximately equal to, or slightly below, rotor top surface 2556.

In one embodiment, rotor 2534 is shaped like a cylinder. Rotor 2534 may be approximately 1.25 inches in diameter and approximately 1.5 inches long. When detaching device 602 is assembled, rotor 2534 fits into rotor cylindrical aperture 2516 of housing 2524 as shown. Rotor 2534 may rotate freely within cylindrical aperture 2516 within limits set by rotor stop pin 2508. In one embodiment, rotor stop pin 2508 is positioned to allow router 2534 to rotate between 0 degrees and at least 45 degrees, as indicated by lines 2602 and 2604, respectively. Rotor return spring 2510 may be an extension spring that biases rotor 2534 to approximately 0 degrees along line 2602 in the rest position.

In one embodiment, rotor 2534 may have a concentric hole cut through it that is slightly larger than protrusion 124 of first end 130. A nest 2506 may be formed in a top surface 2556 of rotor 2534 to conform substantially to first end 130 where upper cover aperture 120 is coincident to axis 2568 of rotor 2534. Protrusion 124 extends downward from nest 2506 into rotor concentric aperture 2542. Further, rotor 2534 is configured to allow first end 132 to slide horizontally out of or into nest 2506. The sliding motion may occur at 0 degrees along line 2602 and is parallel to its long dimension. When sliding into rotor 2534, first end 130 of security tag 100 may slide into rotor 2534 along flat shoulder 504 of lower housing 116 near concentric protrusion 124.

When rotor 2534 is inserted into rotor cylindrical aperture 2516, a top surface 2582 of housing 2524 is approximately 0.25 inches below the level of a rotor shoulder 2606. Dirt and other waste material accumulated by detaching device 602 may fall along rotor concentric aperture 2542. Housing 2524 may have an aperture similar in diameter to rotor concentric aperture 2542 to allow the dirt and waste material to leave detaching device 602.

In one embodiment, rotor 2534 has driver rod apertures 2532 and 2546. Driver rod apertures 2532 and 2546 are in a plane 2410 that is coincident with an axis 2568. Plane 2410 may be at approximately 67.5 degrees relative to the reference line. Rotor 2534 may rotate around axis 2568. Driver rod apertures 2532 and 2546 are positioned on each side of axis 2568 along plane 2410 when rotor 2534 is at approximately 0 degrees. Driver rod apertures 2532 and 2546 each extend from an outer curved surface 2570 of rotor 2534 through the rotor wall at an angle of approximately 45 degrees to axis 2568.

Figure 27:
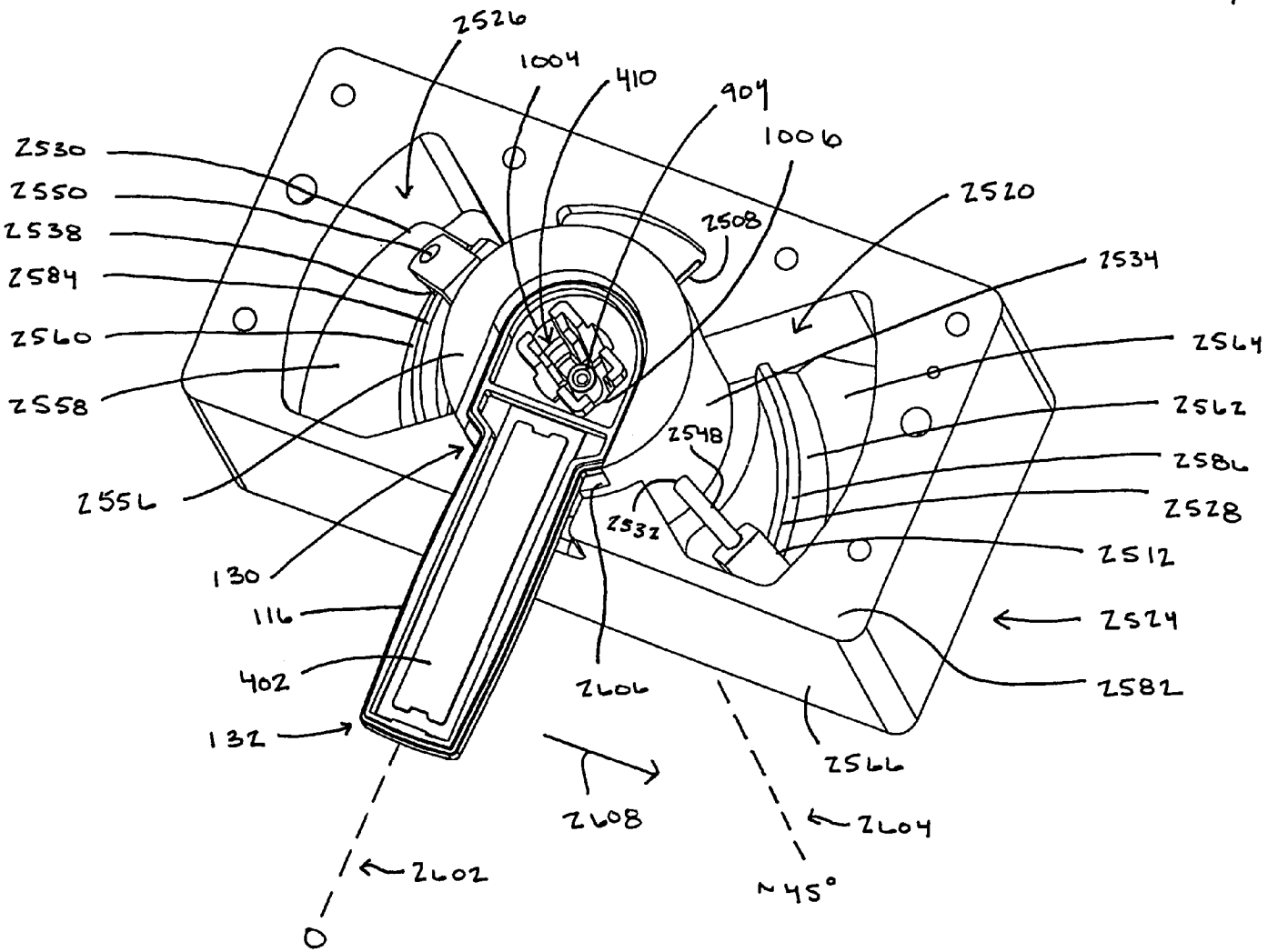
FIG. 27 illustrates an interior view of a detaching device and an inserted lower housing for a security tag in a first position in accordance with one embodiment.

FIG. 27 illustrates an interior view of a detaching device and an inserted lower housing for a security tag in a first position in accordance with one embodiment. FIG. 27 illustrates an interior view of detaching device 602 and an inserted first end 130 of security tag 100 in the first position, with upper housing 114 removed to expose lower housing 116. Lower housing 116 illustrates clamp pocket 410, access walls 1004 and 1006, and lower housing aperture 904.

As shown in FIG. 27, when first end 130 of security tag 100 is inserted into detaching device 602 in the first position, clamp pocket 410 and access walls 1004 and 1006 are in plane 2410, similar to driver rod apertures 2532 and 2546 when rotor 2534 is at approximately 0 degrees.

In one embodiment, driver rods 2540 and 2548 each fit into driver rod apertures 2546 and 2532, respectively. During the detachment operation, driver rods 2540 and 2548 may slide through their respective apertures towards outer wall 134 when second end 132 is moved from the first position to the second position, and away from outer wall 134 when second end 132 is moved from the second position to the first position. When first end 130 is inserted into nest 2506, driver rods 2540 and 2548 may slide far enough through their respective apertures to penetrate access walls 1004 and 1006, to contact end portions 1232 and 1234 of clamp 1200, and bend clamp 1200 about abutment 502 to approximately 90 degrees.

Figure 28:
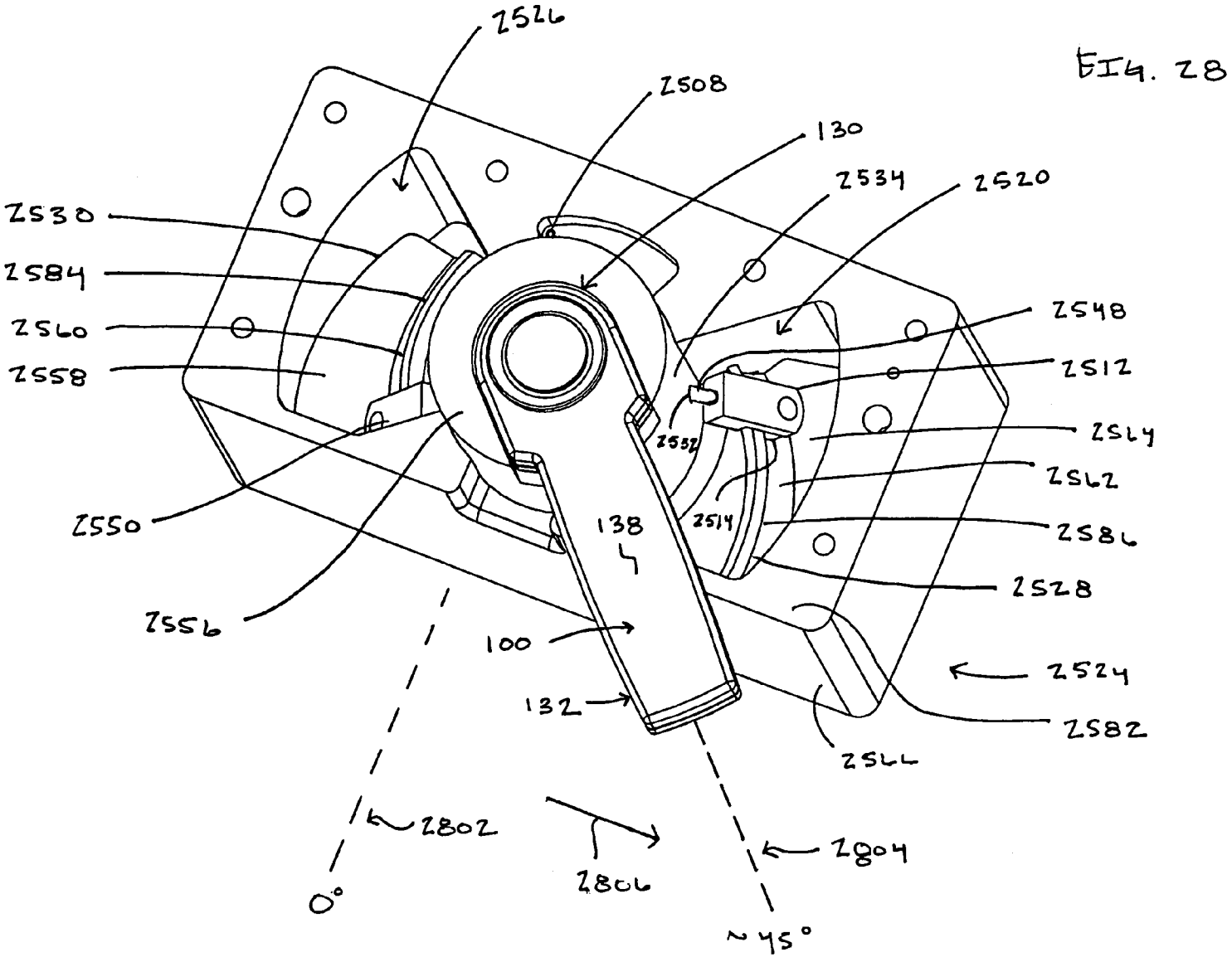
FIG. 28 illustrates an interior view of a detaching device and an inserted security tag in a second position in accordance with one embodiment.
Figure 31:
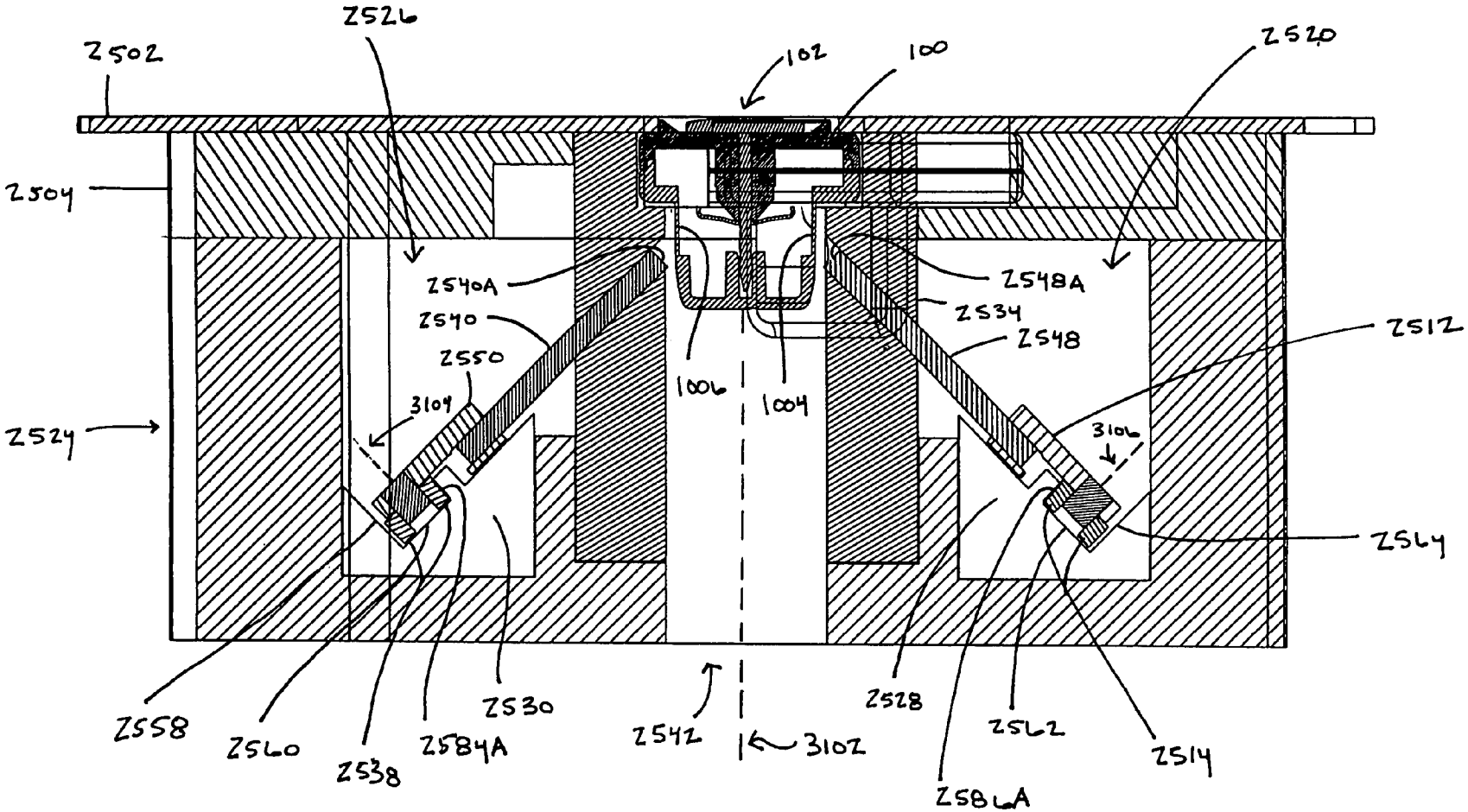
FIG. 31 illustrates a view of a cross-section taken along line P—P (from FIG. 24) of a security tag and detaching device in accordance with one embodiment.

FIG. 28 illustrates an interior view of a detaching device and an inserted security tag in a second position in accordance with one embodiment. FIG. 28 illustrates a security tag 100 inserted into detaching device 602 in the second position. In one embodiment, driver rods 2540 and 2548 may each have at their second end a bearing assembly, such as bearing assemblies 2550 and 2512. Bearing wheels 2514 and 2538 may be attached to bearing assemblies 2512 and 2550, respectively. Bearing wheels 2514 and 2538 are positioned to roll along curved ramps 2528 and 2530, respectively. When rotor 2534 is at 0 degrees along line 2802, the first ends of driver rods 2540 and 2548 are at or inside outer curved surface 2570, as shown in FIG. 31. As rotor 2534 rotates toward 45 degrees along line 2804, bearing wheels 2514 and 2538 bear against and roll up ramp surfaces 2564 and 2558, respectively. Driver rods 2540 and 2548 attached to bearing wheels 2538 and 2514 extend towards outer surface 134 as bearing wheels 2538 and 2514 move up ramp surfaces 2558 and 2564.

In one embodiment, the rate of extension for the driver rods may vary according to the amount of force applied to second end 132 of security tag 100 during the detachment operation, but is typically fairly constant. Further, in one embodiment driver rods 2540 and 2548 move in approximate unison towards outer surface 134, although the embodiments are not limited in this context. Driver rods 2540 and 2548 stop extending when rotor 2534 is stopped by rotor stop pin 2508, or approximately 45 degrees.

In one embodiment, rotor 2534 may be rotated by applying force to second end 132 of security tag 100. As discussed previously, force may be applied to second end 132 to move it from the first position to the second position in direction 2806. At approximately 15 degrees of movement, driver rods 2540 and 2548 have penetrated through outer wall 134. At approximately 26 degrees, driver rods 2540 and 2548 engage clamp 1200. At approximately 45 degrees, driver rods 2540 and 2548 bend clamp 1200 around abutment 502 to an inside angle 1216 of approximately 86–90 degrees.

Figure 29:
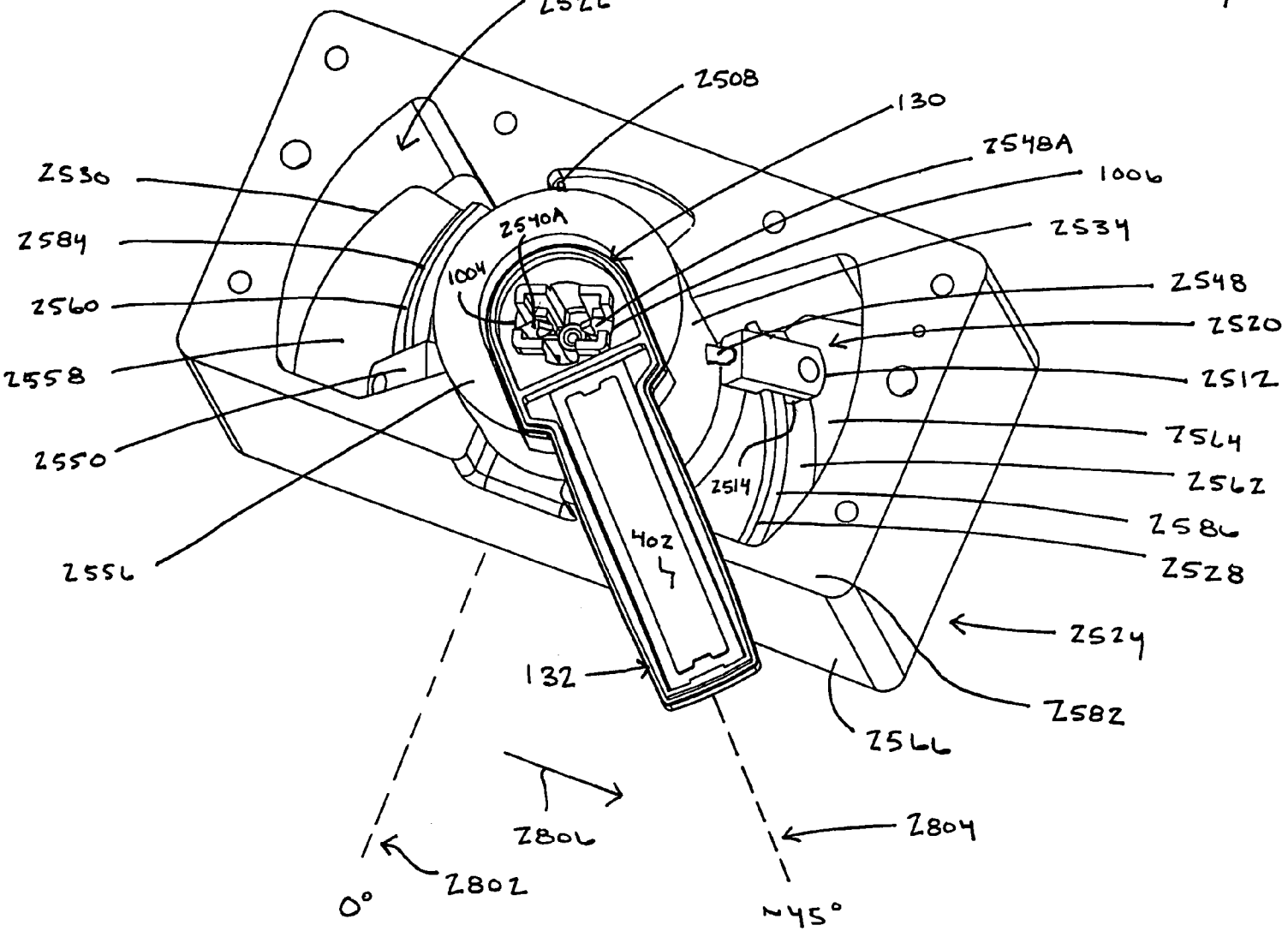
FIG. 29 illustrates an interior view of a detaching device and an inserted lower housing for a security tag in a second position in accordance with one embodiment.

FIG. 29 illustrates an interior view of a detaching device and an inserted lower housing for a security tag in a second position in accordance with one embodiment. FIG. 29 illustrates an interior view of detaching device 602 with an inserted first end 130 of security tag 100 in a first position, with upper housing 114 removed to expose lower housing 116. As shown in FIG. 29, when second end 132 is moved in direction 2806 from a first position to a second position, driver rods 2540 and 2548 penetrate and move through access walls 1004 and 1006, respectively, to access clamp 1200.

Figure 30:
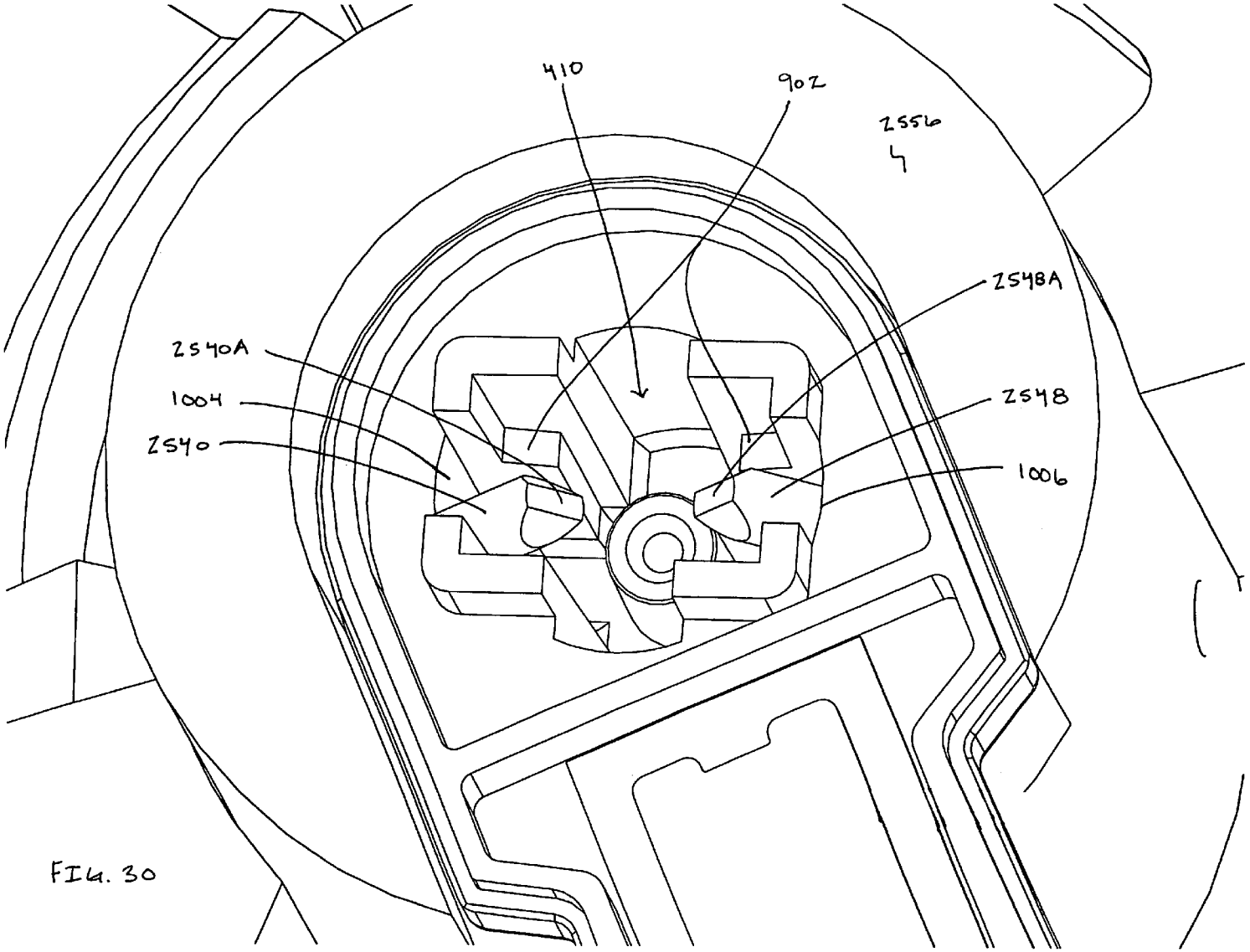
FIG. 30 illustrates an interior view of a lower housing for a security tag having inserted driver rods in accordance with one embodiment.

FIG. 30 illustrates an interior view of a lower housing for a security tag having inserted driver rods in accordance with one embodiment. FIG. 30 illustrates in greater detail an interior view of lower housing 116 of security tag 100 with driver rods 2540 and 2548 penetrating access walls 1004 and 1006, respectively. As stated previously, driver rods 2540 and 2548 may each have a first end that comprises a wedge shaped tip to help penetrate the access walls. FIG. 30 illustrates driving rod 2540 having a wedge shaped tip 2540A at its first end. FIG. 30 also illustrates driver rod 2548 having a wedge shaped tip 2548A at its first end. The wedge shape of tips 2540A and 2548A may facilitate driver rods 2540 and 2548 in cutting through access walls 1004 and 1006, respectively, thereby facilitating penetration into such walls.

Referring again to FIG. 26, once second end 132 of security tag 100 moves to the second position to release tack body 106 from clamp aperture 1206, second end 132 may be returned from the second position to the first position. In one embodiment, this may be accomplished by rotor return spring 2510. Rotor return spring 2510 may be mounted on housing top surface 2582. Rotor return spring 2510 may be positioned to have a relaxed state with sufficient spring tension to bias second end 132 to the first position, or approximately 0 degrees along line 2602. As rotor 2534 is rotated to the second position at approximately 45 degrees along line 2604 in direction 2618, rotor return spring 2510 may be stretched to accommodate the rotation. Once tack body 106 is released, a person may release second end 132, and rotor return spring 2510 will pull rotor 2534 and second end 132 in a direction 2620 back to the first position along line 2602. It may be appreciated that rotor return spring 2510 may be eliminated in one embodiment, and manual force may be used to return rotor 2534 and second end 132 back to their initial position. It may also be appreciated that the movement between the first and second positions may be completely automated as well.

In one embodiment, curved ramps may be made of any stable material, such as aluminum or aluminum filled epoxy. Rotor 2534 may be made of any plastic. In one embodiment, for example, rotor 2534 may comprise a self-lubricating plastic such as Delrin plastic. The self-lubricating Delrin plastic facilitates movement of the driver rods through the driver rod apertures, thereby reducing friction and binding, and also reducing the need to clean and lubricate rotor 2534.

FIG. 31 illustrates a view of a cross-section taken along line P—P of a security tag inserted into a detaching device in accordance with one embodiment. FIG. 31 illustrates a view of a cross-section taken along line P—P of security tag 100 as inserted into detaching device 602. As shown in FIG. 31, bearing wheels 2514 and 2538 are positioned to roll along curved ramps 2528 and 2530, respectively. When rotor 2534 is at 0 degrees, first ends 2540A and 2548A of driver rods 2540 and 2548 are at or inside outer curved surface 2570, but not within rotor concentric aperture 2542. This facilitates inserting first end 130 into nest 2506. As rotor 2534 rotates toward 45 degrees, bearing wheels 2514 and 2538 bear against and roll up ramp surfaces 2564 and 2558, respectively. Driver rods 2540 and 2548 attached to bearing wheels 2538 and 2514 extend towards outer surface 134 as bearing wheels 2538 and 2514 move up ramp surfaces 2558 and 2564.

When returning from the second position to the first position, bearing wheels 2514 and 2538 bear against and roll on down ramp surfaces 2584A and 2586A of fences 2584 and 2586, respectively. Driver rods 2540 and 2548 attached to bearing wheels 2538 and 2514 withdraw from outer surface 134 back within rotor 2534 as bearing wheels 2538 and 2514 move on down ramp surfaces 2584A and 2586A. When driver rods 2540 and 2548 are withdrawn, clamp 1200 is left bent to an inside angle of approximately 114 degrees, and therefore is unable to retain another tack body 106.

In one embodiment, conical surface 2560 is between up ramp surface 2558 and down ramp surface 2584A. Similarly, conical surface 2562 is between up ramp surface 2564 and down ramp surface 2586A. Conical surfaces 2560 and 2562 may provide a sliding surface for the side of each bearing wheel that maintains axis 3104 and 3106, respectively, of each bearing wheel in substantially the same plane as axis 2568. As a result, bearing wheels 2538 and 2514 remain engaged with conical surfaces 2560 and 2562, and driver rods 2540 and 2548 are kept from rotating as they move into outer wall 134 and bend clamp 1200.

In one embodiment, the side of each bearing wheel does not necessarily need to slide along conical surfaces 2560 and 2562. Rather, bearing brackets 2588 and 2590 of bearing assemblies 2550 and 2512, respectively, may slide on top of fences 2584 and 2586, respectively. In this configuration, the sides of bearing wheels 2538 and 2514 may not touch conical surfaces 2560 and 2562, respectively. The embodiments are not limited in this context.

As shown in FIG. 31, bearing wheels 2514 and 2538 may each comprise one or more wheels to roll along their respective curved ramps. In one embodiment, for example, bearing wheels 2514 and 2538 may each comprise two bearing wheels, with a bearing wheel on each side of bearing wheel axis 3106 and 3104, respectively.

In one embodiment, cover 2504 may have a relief channel to house rotor return spring 2510. Cover 2504 may also have a cover aperture 2572 that approximates the diameter of rotor 2534, and is aligned with concentric aperture 2542. Cover 2504 aligns with housing 2524 and encloses curved ramp pockets 2520 and 2526 formed in housing 2524. Rotor top surface 2556 is just below a top surface of cover 2504 approximately 0.006 inches. Alignment pins may be used to align cover 2504 to housing 2524 to ensure rotor 2534 does not bind during rotation. A front edge for cover 2504 has an aperture 2574 forming an extension for nest 2506. This allows first end 130 of security tag 100 to slide directly into nest 2506 as described previously. Shoulders for nest 2506 align with shoulders for aperture 2574. A left side 2576 for aperture 2574 is rounded to facilitate entry of first end 130.

In one embodiment, cover 2504 may have a relief area 2578. Relief area 2578 allows second end 132 to be pushed to the second position. The shape for relief area 2578 not only facilitates movement to the second position, but it also makes it easier to slide first end 130 into detaching device 602. The result is enhanced usability. In addition, relief area 2578 performs a security function. Security tags without an offset 414 of more than approximately 0.2 inches may not be rotated far enough to reach the second position, and therefore may not be detached using detaching device 602.

In one embodiment, cover plate 2502 covers detaching device 602. Cover plate 2502 may be made of a firm thin material such as sheet stainless steel. Cover plate 2502 may be approximately 0.040 inches thick, and has an area that approximately covers cover 2504. Cover plate 2502 may be secured to housing 2524 using flat-head screws inserted into tapped holes drilled into housing 2524, with cover 2504 held between cover plate 2502 and housing 2524. Mounting cover 2504 and cover plate 2502 to housing 2524 does not bind rotor 2534 due to the approximate 0.006 inch spacing referred to above.

In one embodiment, cover plate 2502 may have a relief area 2580. Relief area 2580 may consist of a substantially round hole having an axis that is coincident with axis 2568. Relief area 2580 may have a diameter that is slightly larger than outside wall 134 of concentric rampart 122. One side of relief area 2580 may be removed to allow first end 130 to be inserted into nest 2506. Further, the resulting sharp corners may be rounded to facilitate insertion.

In one embodiment, cover plate 2502 functions to restrain security tag 100 within detaching device 602. Driver rods 2540 and 2548 may provide an upward force to security tag 100 as they are driving through outer wall 134 to bend clamp 1200. Surface 138 of upper housing 114 bears against the corresponding surface for cover plate 2502 as second end 132 is being rotated. Cover plate 2502 also functions to restrain vertical movement of rotor 2534. As driver rods 2540 and 2548 are moving through rotor 2534, there may be a tendency for rotor 2534 to move up from rotor cylindrical aperture 2516. Cover plate 2502 assists in restraining rotor 2534 from this vertical movement during rotation.

Figure 32:
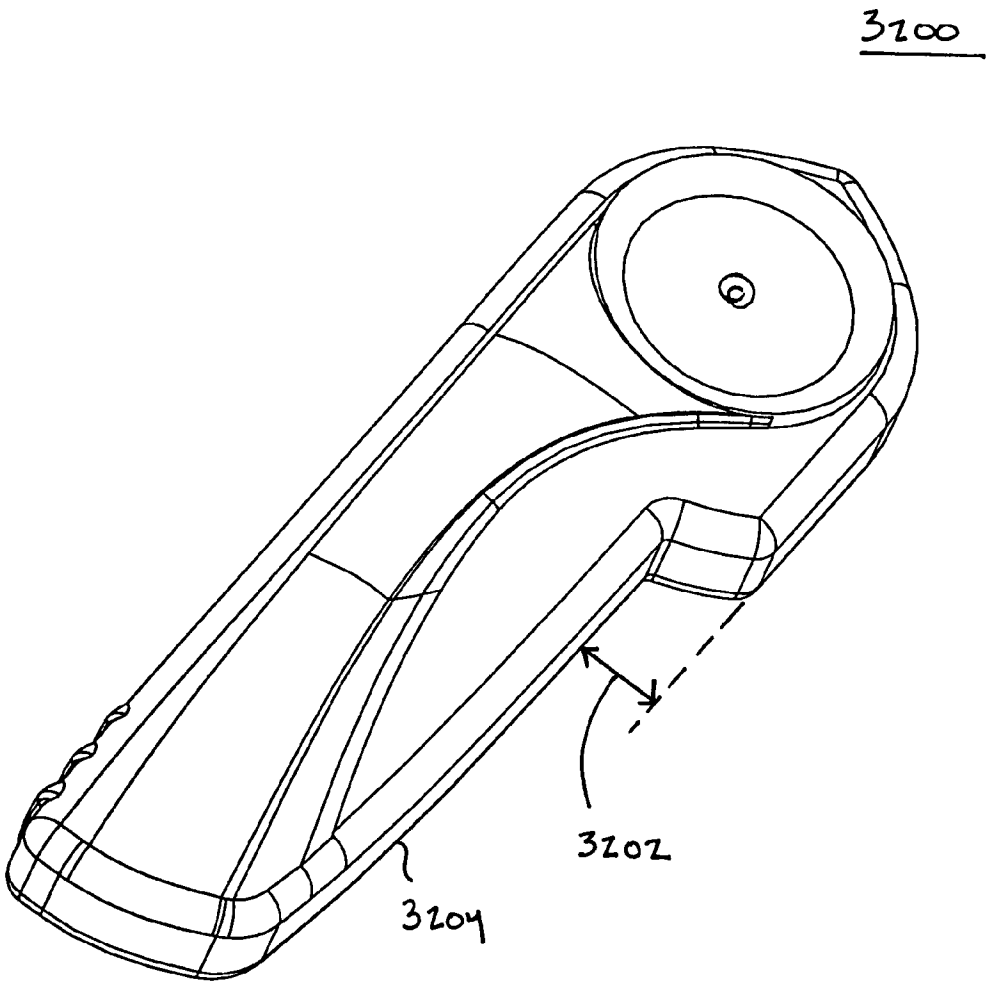
FIG. 32 illustrates an exterior view of an upper housing for a security tag in accordance with one embodiment.

FIG. 32 illustrates an exterior view of an upper housing for a security tag in accordance with one embodiment. FIG. 32 illustrates an upper housing 3200 for a security tag, such as security tag 100, for example. As shown in FIG. 32, upper housing 3200 may have an offset 3202 on one side of security tag 100. Offset 3202 may be representative of, for example, offset 414. Offset 3202 may be on a relief side 3204. Relief side 3204 may be the side of the security tag that moves towards edge 608 when second end 132 is moved from the first position to the second position. Offset 3202 allows rotor 2534 to rotate sufficiently to move the driver rods through outer wall 134 of security tag 100 during the detachment operation.

Figure 33:
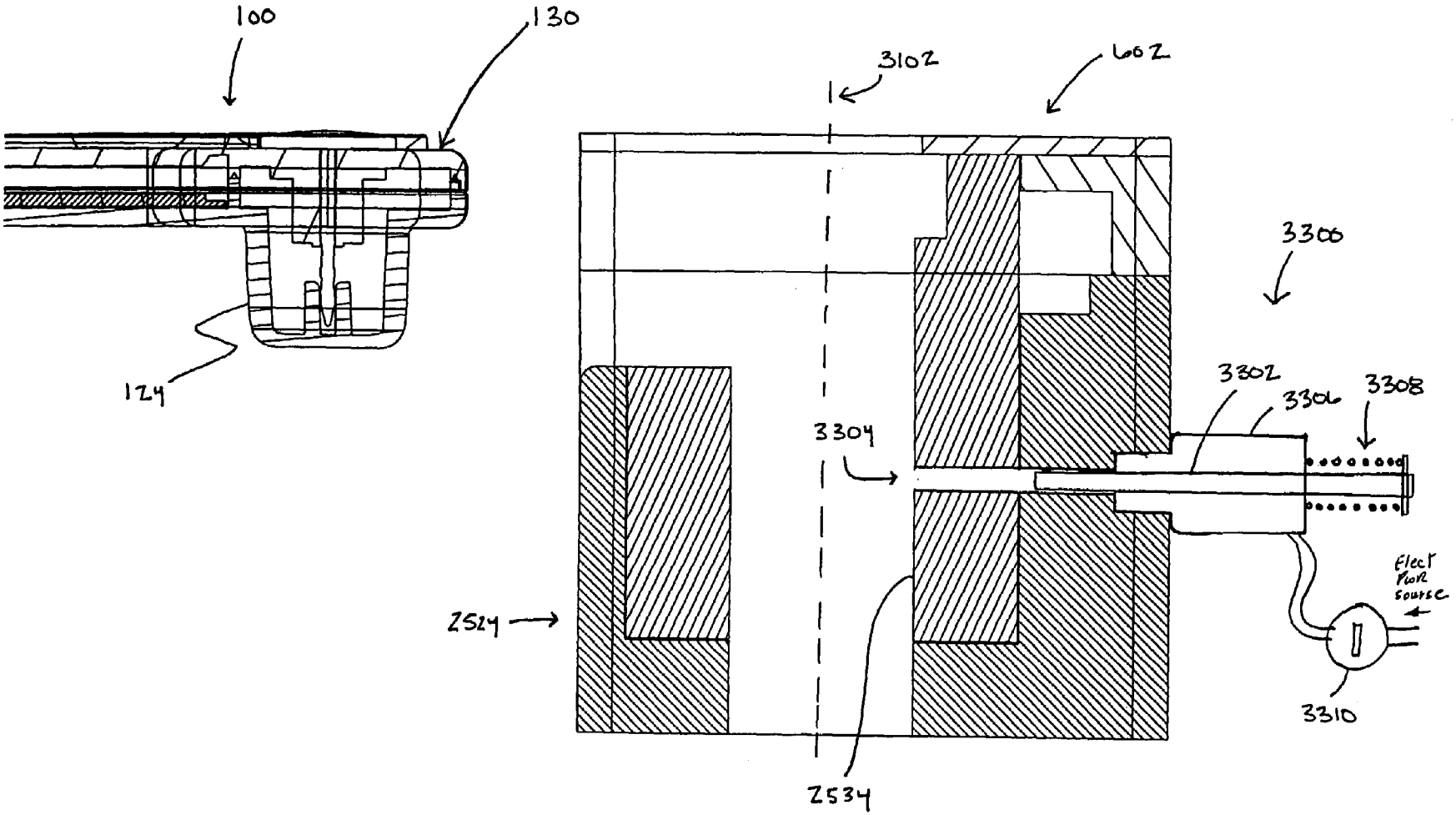
FIG. 33 illustrates a view of a cross-section taken along line C—C (from FIG. 24) of a detaching device and a line D—D (from FIG. 1) of a security tag, with the detaching device having a first securing device in a first position, in accordance with one embodiment.

FIG. 33 illustrates a view of a cross-section taken along line C—C of a detaching device and a line D—D of a security tag, with the detaching device having a first securing device in a first position, in accordance with one embodiment. FIG. 33 may illustrate a securing device 3300 to secure detaching device 602 when not in use. As shown in FIG. 33, a locking bar aperture 3304 may be created perpendicular to rotor axis 3102. Locking bar aperture 3304 may extend through a wall of housing 2524 and into rotor 2534 when rotor 2534 is at approximately 0 degrees. In an unlocked position, locking bar 3302 may be withdrawn into locking bar aperture 3304 such that locking bar 3302 is in the wall of housing 2524, and no part of locking bar 3302 is in rotor 2534. In the unlocked position, rotor 2534 may be rotated inside housing 2524, thereby allowing the detachment operation.

Figure 34:
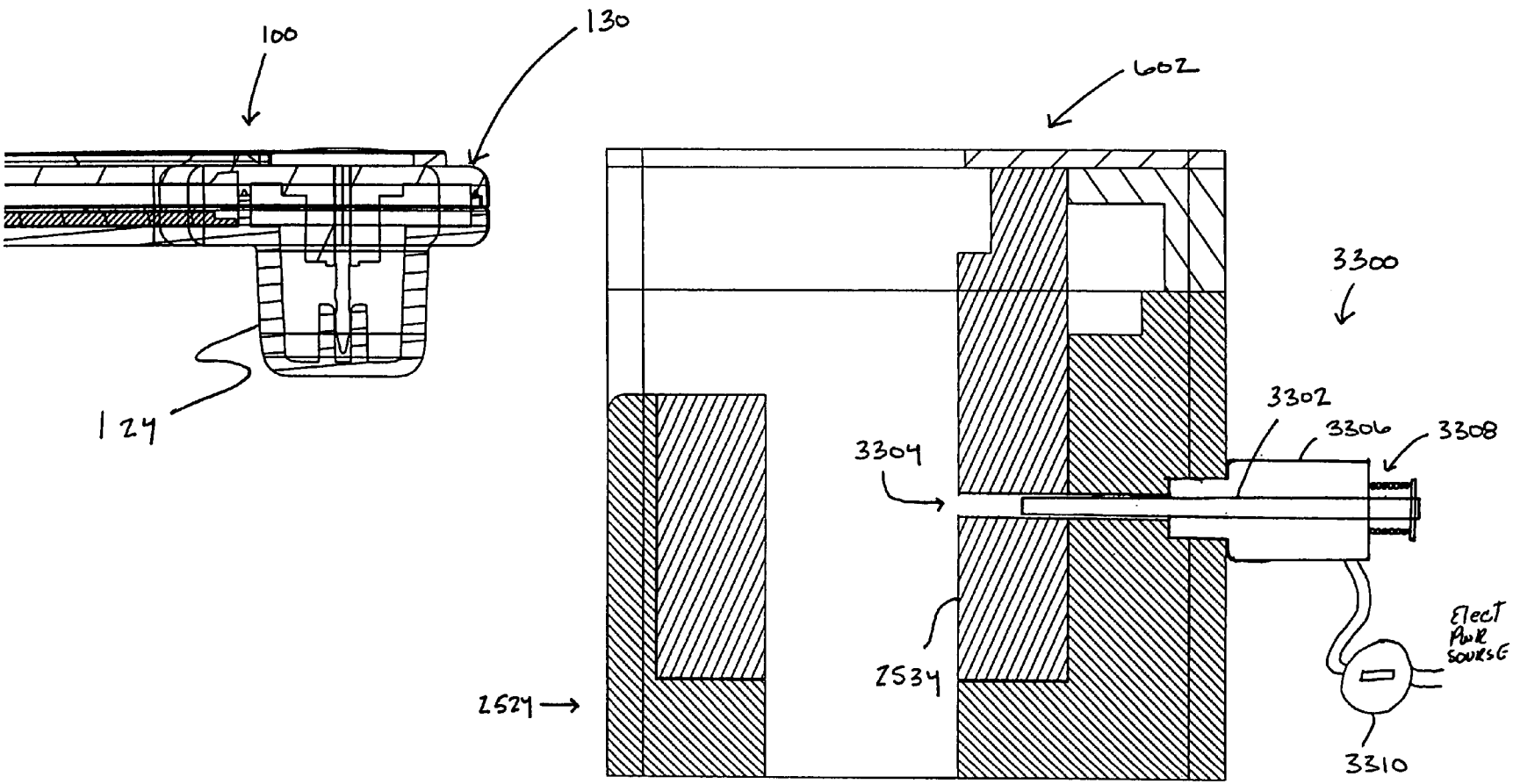
FIG. 34 illustrates a view of a cross-section taken along line C—C of a detaching device and a line D—D of a security tag, with the detaching device having a first securing device in a second position, in accordance with one embodiment.

FIG. 34 illustrates a view of a cross-section taken along line C—C of a detaching device and a line D—D of a security tag, with the detaching device having a first securing device in a second position, in accordance with one embodiment. FIG. 34 may illustrate security device 3300 in a locked position. In the locked position, locking bar 3302 may be inserted into locking bar aperture 3304 such that part of locking bar 3302 is in the wall of housing 2524, and part of locking bar 3302 is in rotor 2534. This may prevent rotor 2534 from being rotated inside housing 2524, thereby preventing the detachment operation.

Movement of locking bar 3302 may be performed manually, automatically, or by a combination of both. In one embodiment, for example, movement of locking bar 3302 may be performed using a key lock having a lever arm. In one embodiment, for example, movement of locking bar 3302 may be performed using a key switch 3310 to control electricity flow to a solenoid 3306. Key switch 3310 may have an on position and an off position. FIG. 33 illustrates key switch 3310 in the off position. FIG. 34 illustrates key switch 3310 in the on position. In the off position, key switch 3310 may shut off electricity flow to solenoid 3306. Solenoid 3306 may control compression spring 3308 by causing it to expand and withdraw locking bar 3302 into the wall of housing 2524. FIG. 33 illustrates compression spring 3308 as expanded. In the on position, key switch 3310 may allow electricity flow to excite solenoid 3306. Solenoid 3306 may control compression spring 3308 by causing it to contract and move locking bar 3302 through locking bar aperture 3304 and into rotor 2538. FIG. 34 illustrates compression spring 3308 as contracted. Key switch 3310 may be the same switch used for other electronic devices used in a business, such as a cash register, or a separate switch. The embodiments are not limited in this context.

Figure 35:
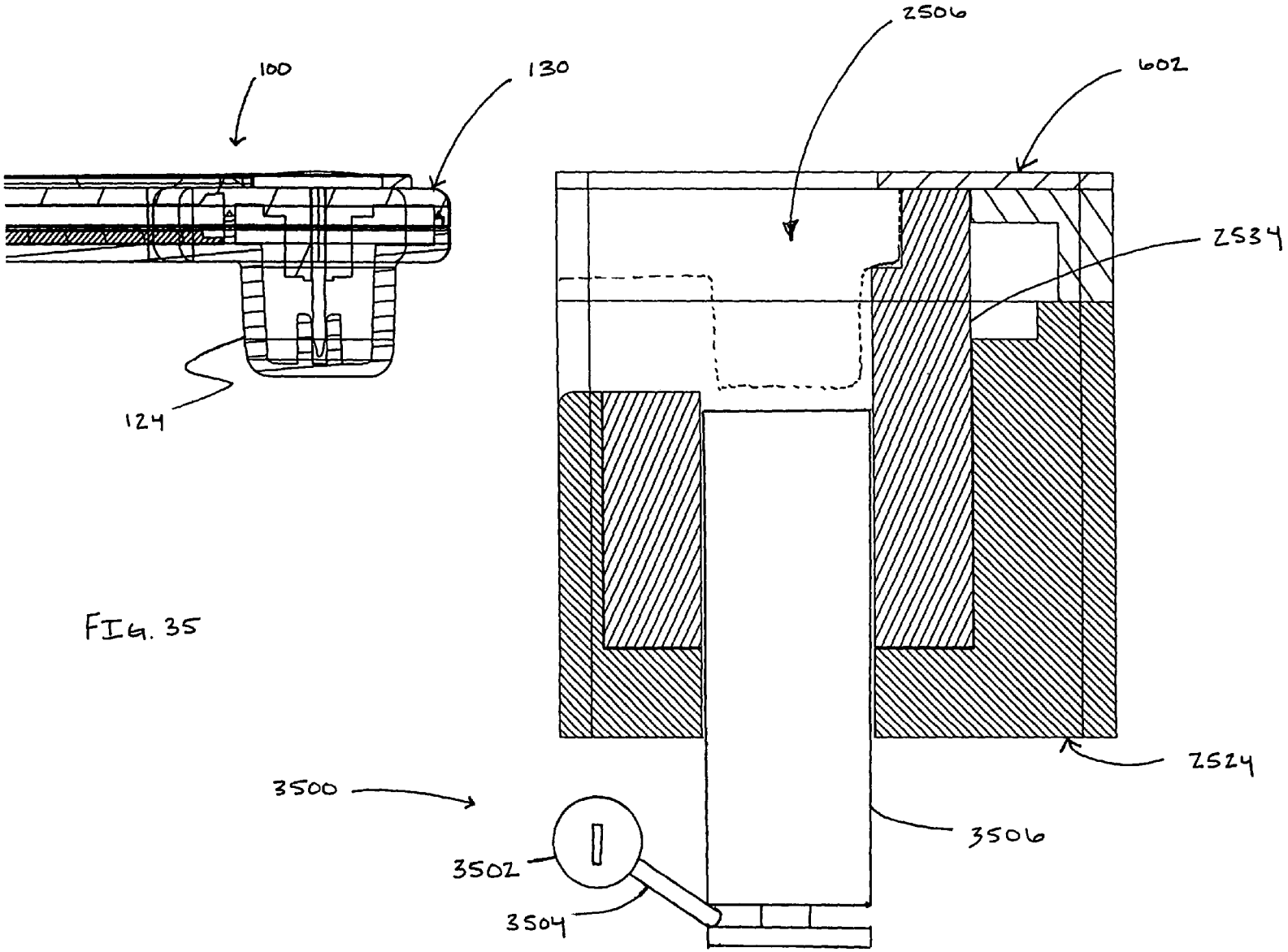
FIG. 35 illustrates a view of a cross-section taken along line C—C of a detaching device and a line D—D of a security tag, with the detaching device having a second securing device in a first position, in accordance with one embodiment.

FIG. 35 illustrates a view of a cross-section taken along line C—C of a detaching device and a line D—D of a security tag, with the detaching device having a second securing device in a first position, in accordance with one embodiment. FIG. 35 may illustrate a securing device 3500 to secure detaching device 602 when not in use. In one embodiment, securing device 3500 may secure detaching device 602 by blocking nest 2506 to prevent first end 130 of security tag 100 from being inserted into nest 2506. A circular locking bar 3506 can fit into rotor cylindrical aperture 2542. FIG. 35 illustrates circular locking bar 3506 in an unlocked position. In the unlocked position, circular locking bar 3506 may be withdrawn from nest 2506 to allow first end 130 of security tag 100 to be inserted into nest 2506 of detaching device 602.

Figure 36:
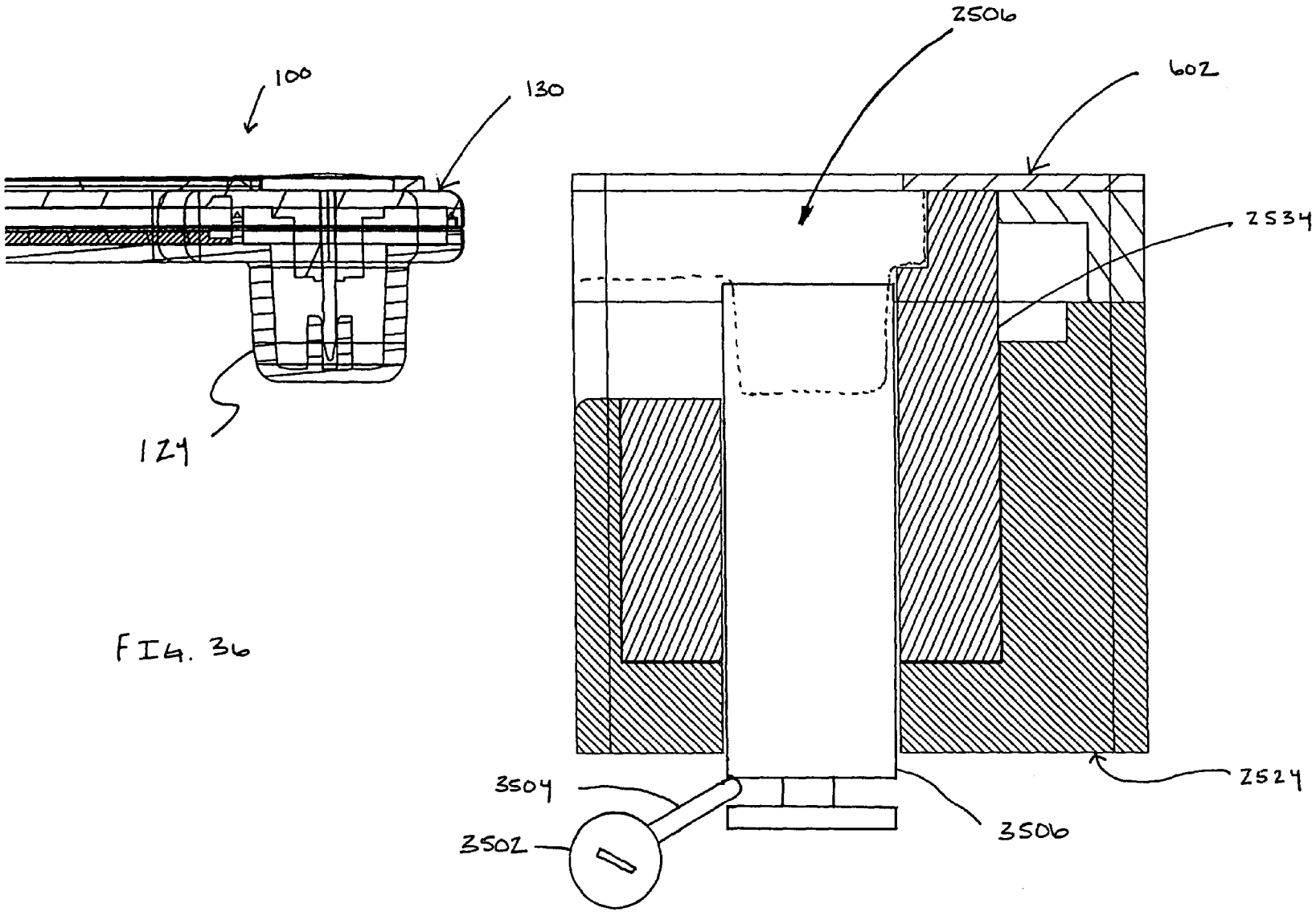
FIG. 36 illustrates a view of a cross-section taken along line C—C of a detaching device and a line D—D of a security tag, with the detaching device having a second securing device in a second position, in accordance with one embodiment.

FIG. 36 illustrates a view of a cross-section taken along line C—C of a detaching device and a line D—D of a security tag, with the detaching device having a second securing device in a second position, in accordance with one embodiment. FIG. 36 may illustrate securing device 3500 in a locked position. In the locked position, circular locking bar 3506 may be moved into nest 2506 to prevent first end 130 of security tag 100 from being inserted into nest 2506 of detaching device 602.

Movement of circular locking bar 3506 may be performed manually, automatically, or by a combination of both. In one embodiment, for example, movement of circular locking bar 3506 may be performed using a key lock 3502 having a lever arm 3504. FIG. 35 illustrates key lock 3502, lever arm 3504 and circular locking bar 3506 in the unlocked position. FIG. 36 illustrates key lock 3502, lever arm 3504 and circular locking bar 3506 in the locked position. In another embodiment, for example, movement of circular locking bar 3506 may be accomplished automatically, using a mechanism similar to the one described with reference to FIGS. 33 and 34.

It is worthy to note that the locking mechanisms described herein may be biased towards a locked position, in the event of a power loss or some other external event that affects the operation of the detaching device. For example, if the locking mechanism is powered by a motor, and the power is cut off, the locking mechanism may automatically assume a locked position using a residual power source, such as a battery. In another example, the locking mechanism may always be in a locked position initially, and only unlocks prior to performing the detachment operation.

While certain features of the embodiments have been illustrated as described herein, many modifications, substitutions, changes and equivalents will now occur to those skilled in the art. It is, therefore, to be understood that the appended claims are intended to cover all such modifications and changes as fall within the true spirit of the embodiments.

The invention claimed is:

1. A security system, comprising: a security tag to attach to an item, said security tag having art outer wall: arid a detaching device having at least one driver rod, said driver rod to penetrate said outer wall at approximately a 45 degree angle relative to said outer wall to detach said security tag from said item.

2. The security system of claim 1, wherein said detaching device includes two driver rods.

3. The security system of claim 2, wherein said security tag comprises: a tack body; a security tag to receive said lack body; a clamp disposed within said security tag to retain said tack body; and wherein said driver rod bends said clamp beyond a yield point to release said tack body.

4. The security system of claim 3, wherein said clamp includes a concave surface, said concave surface having a first angle when said clamp retains said tack body, and a second angle when said clamp releases said tack body.

5. The security system of claim 4, wherein said first angle comprises an angle from a set of angles comprising 146–180 degrees.

6. The security system of claim 4, wherein said first angle comprises an angle of approximately 164 degrees.

7. The security system of claim 4, wherein said second angle comprises an angle from a set of angles comprising 90–145 degrees.

8. The security system of claim 4, wherein said second angle comprises an angle of approximately 105 degrees.

9. The security system of claim 1, wherein said outer wall comprises a thickness that may be penetrated by approximately 5 to 15 pounds of force received from said driver rod.

10. The security system of claim 1, wherein said outer wall comprises a plastic material with a thickness of approximately 0.01 to 0.024 inches.

11. The security system of claim 3, wherein said outer wall has at least one aperture after said clamp is bent.

12. The security system or claim 3, wherein said security tag comprises an upper housing and a lower housing, said lower housing having a protrusion with said outer wall, said outer wall having two access points to allow penetration by said driver rods to bend said clamp.

13. The security system of claim 12, wherein said clamp comprises a center portion and two end portions, with said upper housing having an abutment positioned above said center portion to provide resistance against said clamp while said driver rods contact each end portion to bend said clamp towards said abutment.

14. The security system of claim 3, wherein said detaching device comprises: a rotor having a nest and concentric aperture to receive and hold a first end of said security tag, said rotor to rotate from a first position to a second position in response to force applied to a second end of said security tag, said rotor having a plurality of apertures; said driver rods, with each driver rod having a first end positioned within a corresponding aperture and a second end having a bearing assembly and a bearing wheel; a plurality of curved ramps positioned to assist movement of said first ends of said driver rods through said apertures and toward said first end of said security tag as said second ends of said driver rods move along said ramps during said rotation; and a top cover to inhibit vertical movement of said rotor during said rotation.

15. The security system of claim 14, wherein force is received by said second end of said security tag to rotate said rotor from said first position to said second position, said rotation applying force to said first ends of said driver rods thereby moving said second ends of said driver rods along said ramps, with said movement causing said first ends of said driver rods to move through said apertures towards said first end of said security tag until said first ends of said driver rods penetrate said outer wall to bend said clamp beyond said yield point.

16. The security system of claim 15, wherein force is received by said second end of said security tag to rotate said rotor from said second position to said first position, said rotation applying force to said first ends of said driver rods thereby moving said second ends of said driver rods along said ramps, with said movement causing said first ends of said driver rods to move through said apertures away from said first end of said security tag until said first ends of said driver rods withdraw from said outer wall.

17. The security system of claim 14, wherein each curved ramp includes an up ramp and a down ramp, with said bearing wheels to bear against and roll tip said up ramp to assist movement of said first ends of said driver rods towards said first end of said security tag, and said bearing wheels to bear against and roll down said down ramp to assist movement of said first ends of said driver rods away from said first end of said security tag.

18. The security system of claim 14, wherein said first end of said security tag comprises a tag head and a protrusion with said outer wall, with said nest to receive and hold said tag head to assist said rotation, and said concentric aperture to receive said protrusion to allow said driver rods to access said outer wall.

19. The security system of claim 14, wherein said detaching device further comprises: a locking bar; said rotor having a side wall with an aperture to receive said locking bar; and wherein said locking bar to receive force to move said locking bar through said aperture from a first position to a second position, with said locking bar in said second to position to prevent rotation of said rotor.

20. The security system of claim 14, wherein said detaching device further comprises a locking bar, with said locking bar to receive force to move said locking bar through said concentric aperture from a first position to a second position, with said locking bar in said second position preventing said rotor from receiving said first end of said security tag.

21. A security tag, comprising: a tack body; a security tag including an outer wall to receive said tack body; and a clamp disposed within said security tag to retain said tack body, said clamp to receive force at approximately a 45 degree angle relative to said outer wall sufficient to bend said clamp beyond a yield point and release said tack body.

22. The security tag of claim 21, wherein said clamp includes a concave surface, said concave surface having a first angle when said clamp retains said tack body, and a second angle when said clamp releases said tack body.

23. The security tag of claim 22, wherein said first angle comprises an angle from a set of angles comprising 116–180 degrees.

24. The security tag of claim 22, wherein said first angle comprises an angle of approximately 164 degrees.

25. The security tag of claim 22, wherein said second angle comprises an angle from a set of angles comprising 90–145 degrees.

26. The security tag of claim 22, wherein said second angle comprises an angle of approximately 105 degrees.

27. The security tag of claim 21, wherein said outer wall comprises a thickness that may he penetrated by approximately 5 to 15 pounds of force.

28. The security tag of claim 21, wherein said outer wall comprises a hard plastic material with a thickness of approximately 0.01 to 0.024 inches.

29. The security tag of claim 21, wherein said outer wall has at least one aperture after said clamp is bent.

30. The security tag of claim 21, wherein said security tag comprises an upper housing and a lower housing, said lower housing having a protrusion with said outer wall, said outer wall having two access points to allow penetration by a pair of corresponding objects to bend said clamp.

31. The security tag of claim 30, wherein said clamp comprises a center portion and two end portions, with said upper housing having an abutment positioned above said center portion to provide resistance against said clamp while said driver rods contact each end portion to bend said clamp towards said abutment.

32. A detaching device, comprising: a rotor having a nest and concentric aperture to receive and hold a first end of a security tag, said rotor to rotate from a first position to a second position in response to force applied to a second end of said security tag, said rotor having a plurality of apertures; driver rods, with each driver rod having a first end positioned within a corresponding aperture and a second end having a bearing assembly and a bearing wheel; a plurality of curved ramps positioned to assist movement of said first ends of said driver rods through said apertures and toward said first end of said security tag as said second ends of said driver rods move along said ramps during said rotation; and a top cover to inhibit vertical movement of said rotor during said rotation.

33. The detaching device of claim 32, wherein said security tag includes a tack body, a security tag and a clamp disposed therein to retain said tack body, and force is received by said second end of said security tag to rotate said rotor from said first position to said second position, said rotation applying force to said first ends of said driver rods thereby moving said second ends of said driver rods along said ramps, with said movement causing said first ends of said driver rods to move through said apertures towards said first end of said security tag until said first ends of said driver rods penetrate an outer wall to bend said clamp beyond a yield point to release said tack body.

34. The detaching device of claim 33, wherein force is received by said second end of said security tag to rotate said rotor from said second position to said first position, said rotation applying force to said first ends of said driver rods thereby moving said second ends of said driver rods along said ramps, with said movement causing said first ends of said driver rods to move through said apertures away from said first end of said security tag until said first ends of said driver rods withdraw from said outer wall.

35. The detaching device of claim 32, wherein each curved ramp includes an up ramp and a down ramp, with said bearing wheels to bear against and roll up said up ramp to assist movement of said first ends of said driver rods towards said first end of said security tag, and said bearing wheels to bear against and roll down said down ramp to assist movement of said first ends of said driver rods away from said first end of said security tag.

36. The detaching device of claim 32, wherein said first end of said security tag comprises a tag head and a protrusion with an outer wall, with said nest to receive and hold said tag head to assist said rotation as there is applied to said second end of said security tag, and said concentric aperture to receive said protrusion to allow said driver rods to access said outer wall.

37. The detaching device of claim 32, wherein said detaching device further comprises: a locking bar; said rotor having a side wall with an aperture to receive said locking bar; and wherein said locking bar to receive force to move said locking bar through said aperture from a first position to a second position, with said locking bar in said second position to prevent rotation of said rotor.

38. The detaching device of claim 32, wherein said detaching device further comprises a locking bar, with said locking bar to receive force to move said locking bar through said concentric aperture from a first position to a second position, with said locking bar in said second position preventing said rotor from receiving said first end of said security tag.

39. A security system, comprising: a security tag comprising a tack body, a security tag including an outer wall and a clamp disposed within said security tag to retain said tack body, said clamp to receive force at approximately a 45 degree angle relative to said outer wall sufficient to bend said clamp beyond a yield point and release said tack body; a monitoring system to detect said security tag; and an alert system to communicate an alert if said monitoring system detects said security tag.

40. The security system of claim 39, wherein said security tag includes an outer wall, and further comprising a detachment device having driver rods to detach said security tag from an item by having said driver rods penetrate said outer wall to bend said clamp.

41. The security system of claim 39, wherein said security tag also includes a sensor emitting signals at a certain frequency, and wherein said monitoring system comprises a transceiver to detect said signals.

42. A security tag, comprising: a tack body; a security tag to receive said tack body; and a clamp disposed within said security tag to retain said tack body, said clamp to receive force from at least one driver rod at approximately a 45 degree angle relative to the security tag to bend said clamp beyond a release point and release said tack body.

43. The security tag of claim 42, wherein said clamp has a first position to retain said tack body, and a second position to release said tack body, with said second position moving to said first position after said clamp release said tack body.

44. The security tag of claim 42, wherein said security tag further comprises an outer wall, said outer wall having at least one aperture to receive said driver rod and allow said driver rod to contact said clamp to apply said force.

45. The security tag of claim 42, wherein said security tag further comprises an outer wall, said outer wall to be penetrated by said driver rod to contact said clamp to apply said force.

46. A detaching device, comprising: at least one driver rod; and a driver rod activator to move said driver rod through an outer wall of a security tag at approximately a 45 degree angle relative to the outer wall to bend a clamp to a release point and detach said security tag from an item.

47. The detaching device of claim 46, wherein said driver rod activator comprises a motor to move said driver rod.

48. The detaching device of claim 46, wherein said driver rod activator receives manual force to move said driver rod.

49. The detaching device of clam 46, wherein said driver rod activator comprises a rotor to receive manual force to move said driver rod.

* * * * *